US006336894B1

(12) United States Patent
Kestila

(10) Patent No.: US 6,336,894 B1
(45) Date of Patent: Jan. 8, 2002

(54) CONVERGENT VECTOR RESISTANCE DEVICE

(76) Inventor: W. David Kestila, 7314 Sunset Ave., Panama City Beach, FL (US) 32408

( * ) Notice: Subject to any disclaimer, the term of this patent is extended or adjusted under 35 U.S.C. 154(b) by 0 days.

(21) Appl. No.: 09/454,072

(22) Filed: Dec. 2, 1999

(51) Int. Cl.[7] ..... A63B 21/072

(52) U.S. Cl. ..... 482/99; 482/108; 482/121; 482/139

(58) Field of Search ..... 482/50, 92, 93, 482/98, 99, 102, 103, 106, 107, 108, 104, 109, 139, 121, 129, 130

(56) References Cited

U.S. PATENT DOCUMENTS

| | | | | |
|---|---|---|---|---|
| 3,858,873 A | | 1/1975 | Jones | |
| 3,948,513 A | | 4/1976 | Pfotenhauer | |
| 4,154,441 A | | 5/1979 | Gajda | |
| 4,253,662 A | * | 3/1981 | Podolak | 482/104 |
| 4,361,324 A | * | 11/1982 | Baroi | 482/108 |
| 4,471,956 A | * | 9/1984 | Marlo | 482/104 |
| 4,566,690 A | | 1/1986 | Schook | |
| 4,627,615 A | | 12/1986 | Nurkowski | |
| 4,948,123 A | | 8/1990 | Schook | |
| 4,949,955 A | * | 8/1990 | Keen | 482/93 |
| 4,973,050 A | * | 11/1990 | Santoro et al. | 482/102 |
| 4,998,723 A | | 3/1991 | Santoro | |
| 5,029,849 A | | 7/1991 | Nurkowski | |
| 5,108,354 A | * | 4/1992 | Becker | 482/104 |
| 5,300,003 A | * | 4/1994 | Hull | 482/139 |
| 5,346,448 A | | 9/1994 | Sollo | |
| 5,653,665 A | * | 8/1997 | Neeley | 482/106 |
| 5,813,951 A | | 9/1998 | Einsig | |
| 5,891,004 A | | 4/1999 | Berry | |

FOREIGN PATENT DOCUMENTS

| | | | | |
|---|---|---|---|---|
| FR | 400283 | * | 7/1909 | 482/129 |
| GB | 7290 | * | 4/1899 | 482/106 |
| GB | 363 | * | 1/1912 | 482/129 |

OTHER PUBLICATIONS

Commercial Equipment, 1998, Strive Enterprises "Target Loading".

* cited by examiner

*Primary Examiner*—Mickey Yu
*Assistant Examiner*—Victor K. Hwang

(57) ABSTRACT

An exercise device that connects multiple vectors of resistance to a common unit whereby manipulation of a user will result in resistance to movement. The device has individual connectable parts and when combined will provide numerous opportunities for rehabilitation, testing, and health/fitness exercise. The device comprises a handle (20) used for gripping, that has on its ends a smaller elongated smooth shaft (24) which on one end has a threaded surface (26) and on the other a bulk head (22) for which a plate (52) is positioned against. Between the plate and the smooth shaft, a washer (40) is placed to reduce friction between plate and handle. The plate is secured on the smooth shaft by screwing a socket head nut (70) onto the threaded portion of the shaft. After the shaft is placed through a washer (66) it is placed adjacent to the plate and combined with a second washer (68) placed adjacent to the previous. These two washers reduce friction on the other side of the plate and conclude the assembly of the device with the tightening of the socket head nut. A half ring (82) on the plate is the source for connecting the device to a spring clip (94), which is also connected to a ring connector (100) that is secured onto a lanyard (104). Since this connection is done on both plates, the lanyard will come together at a common lanyard crimp (106) followed by the crimping of a common ring connector (102) onto the distal end of the combined lanyards. The connection of the device is finalized and operable after using another spring clip to attach the common ring connector to a cable-pulley system (124) or unit of equipment.

19 Claims, 23 Drawing Sheets

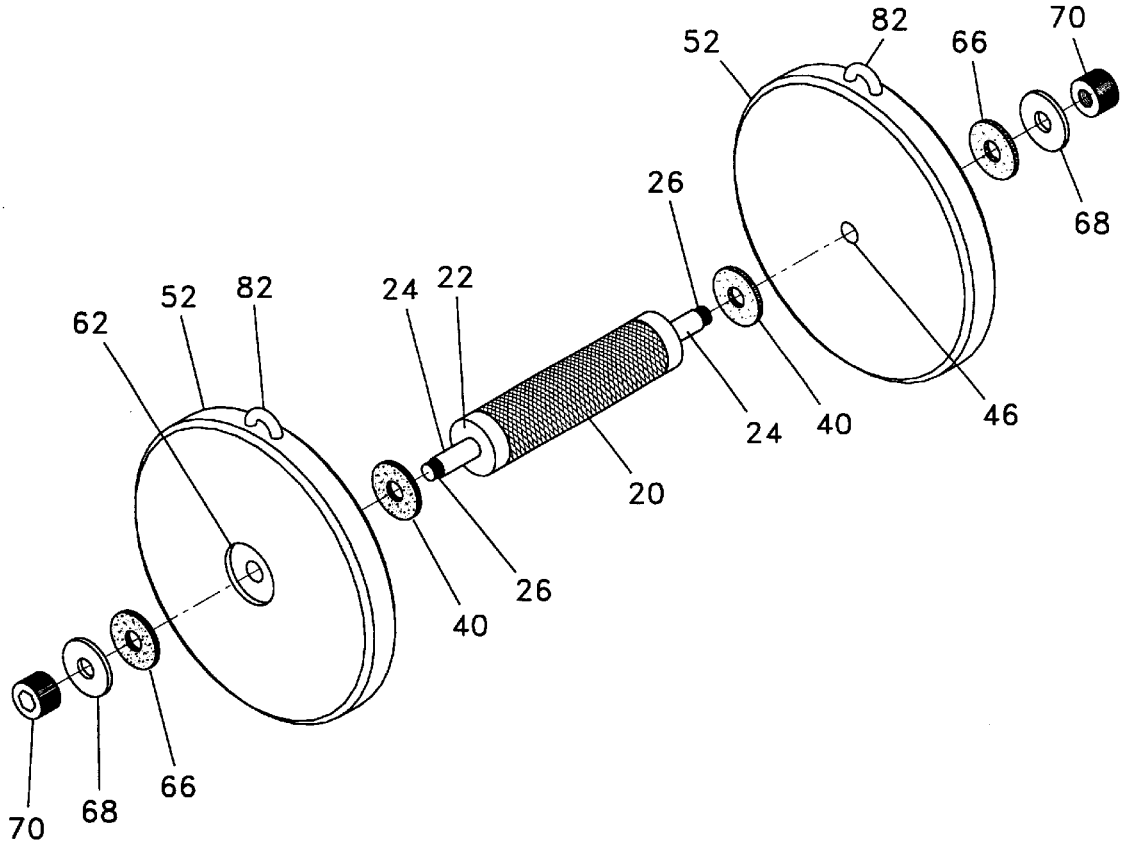
Fig. 1–A

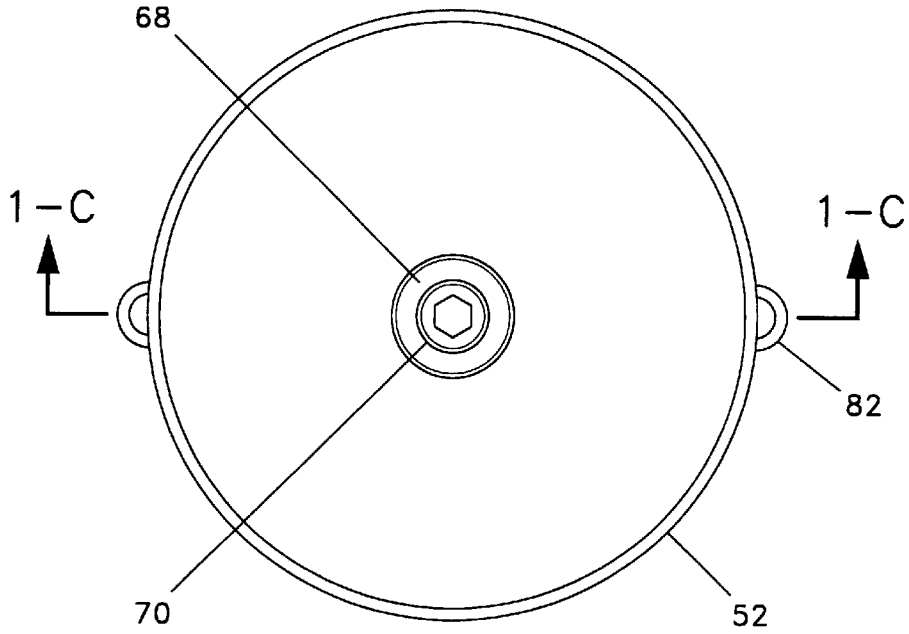
Fig. 1-B
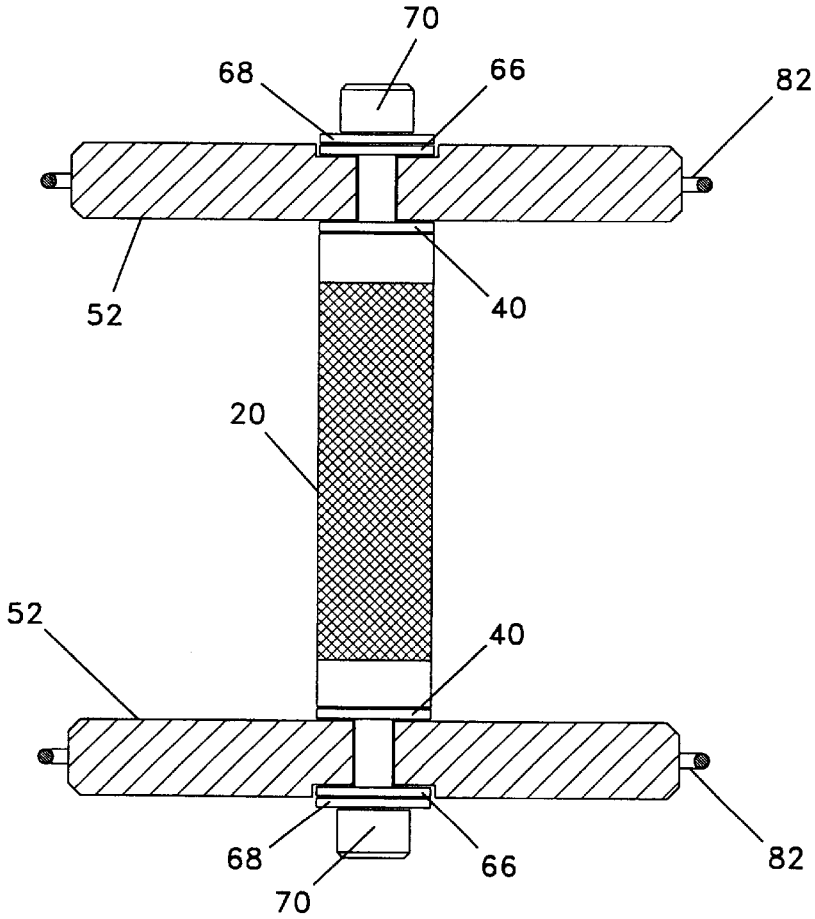
Fig. 1-C

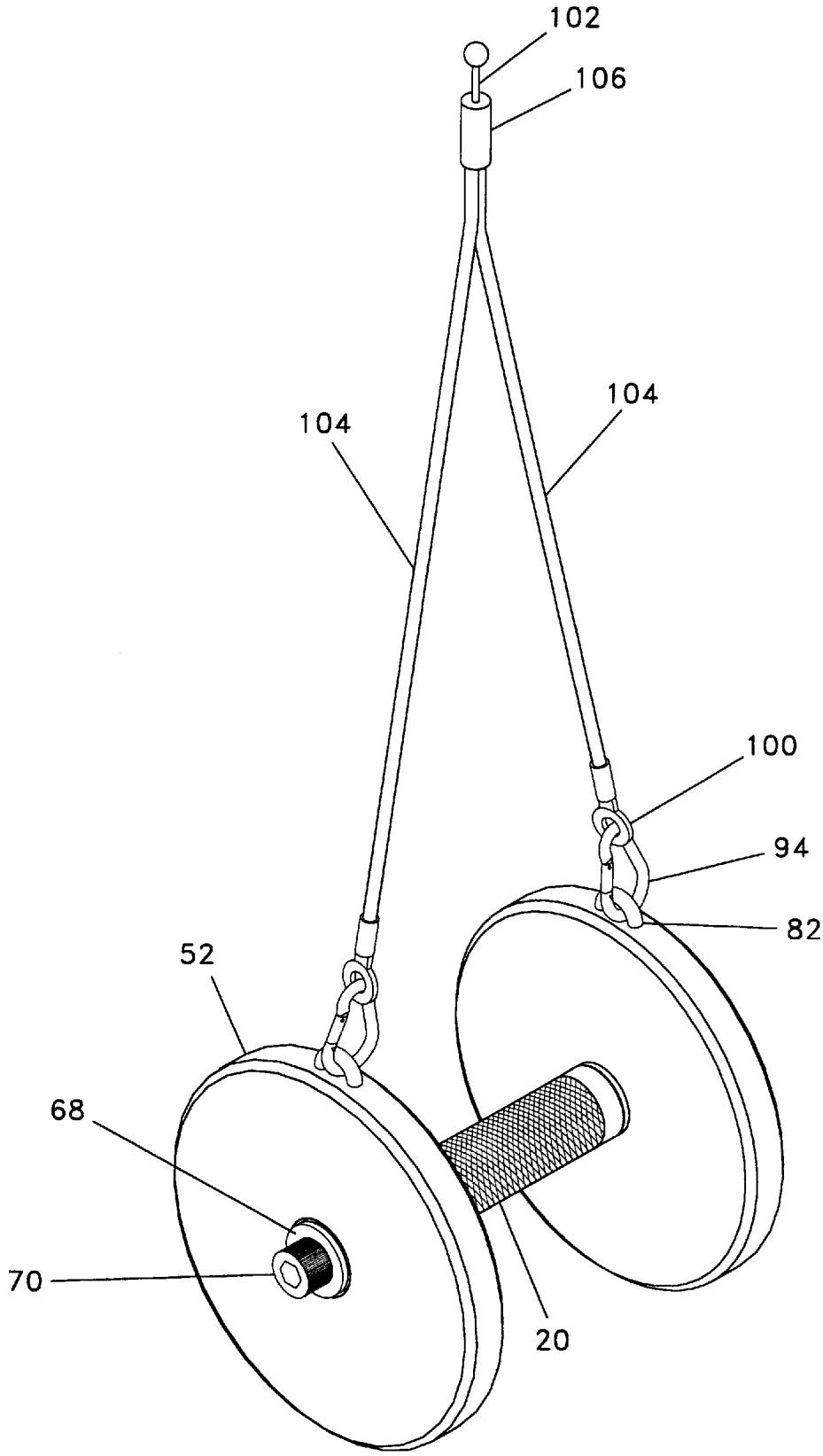
Fig. 1-D

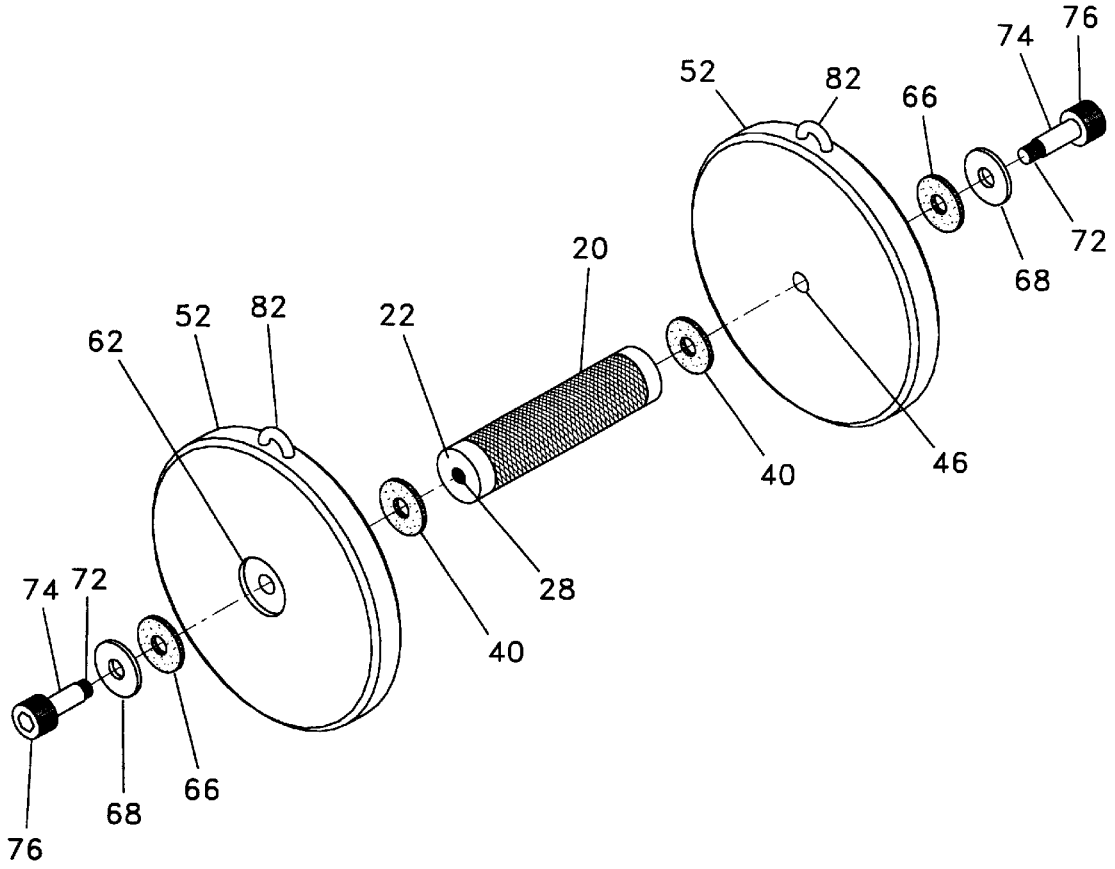
Fig. 2-A

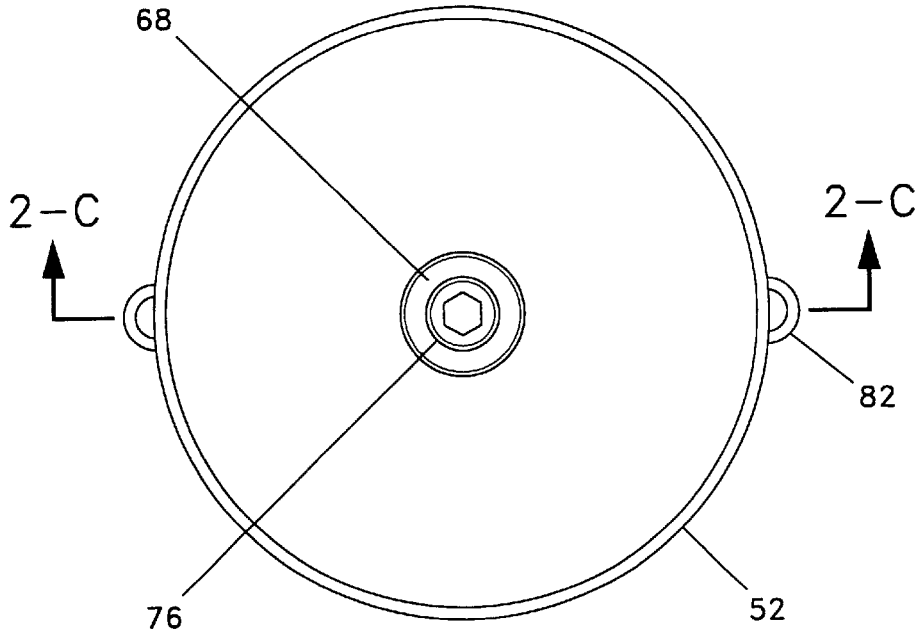
Fig. 2-B
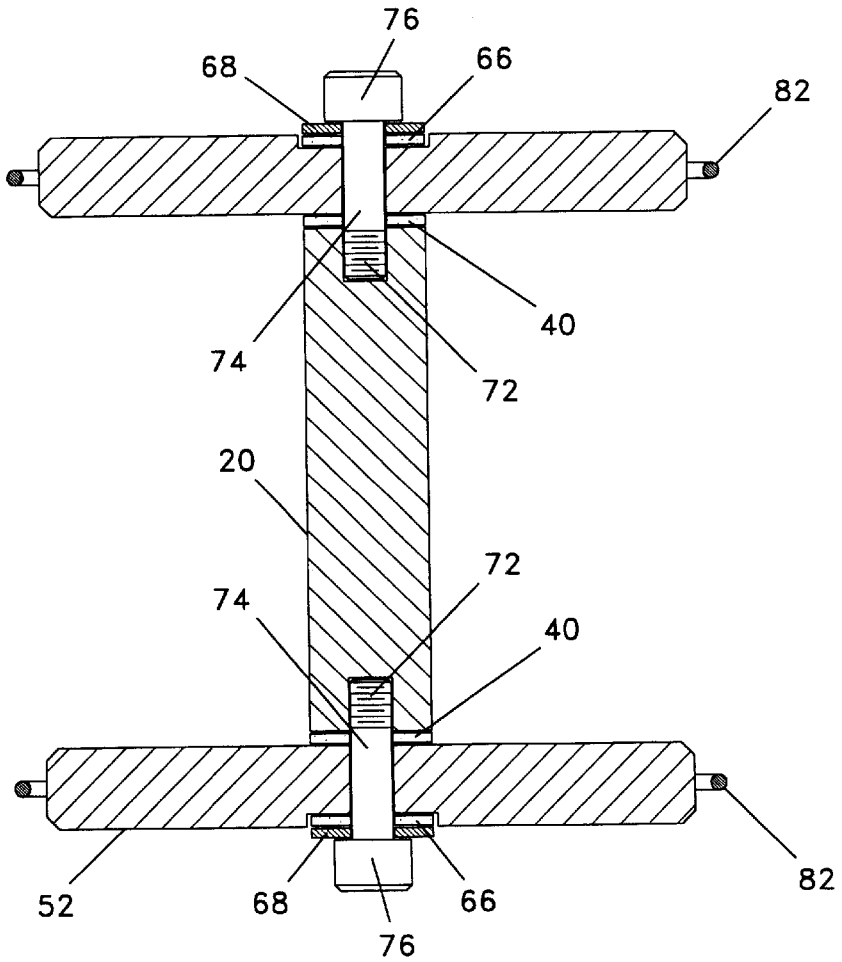
Fig. 2-C

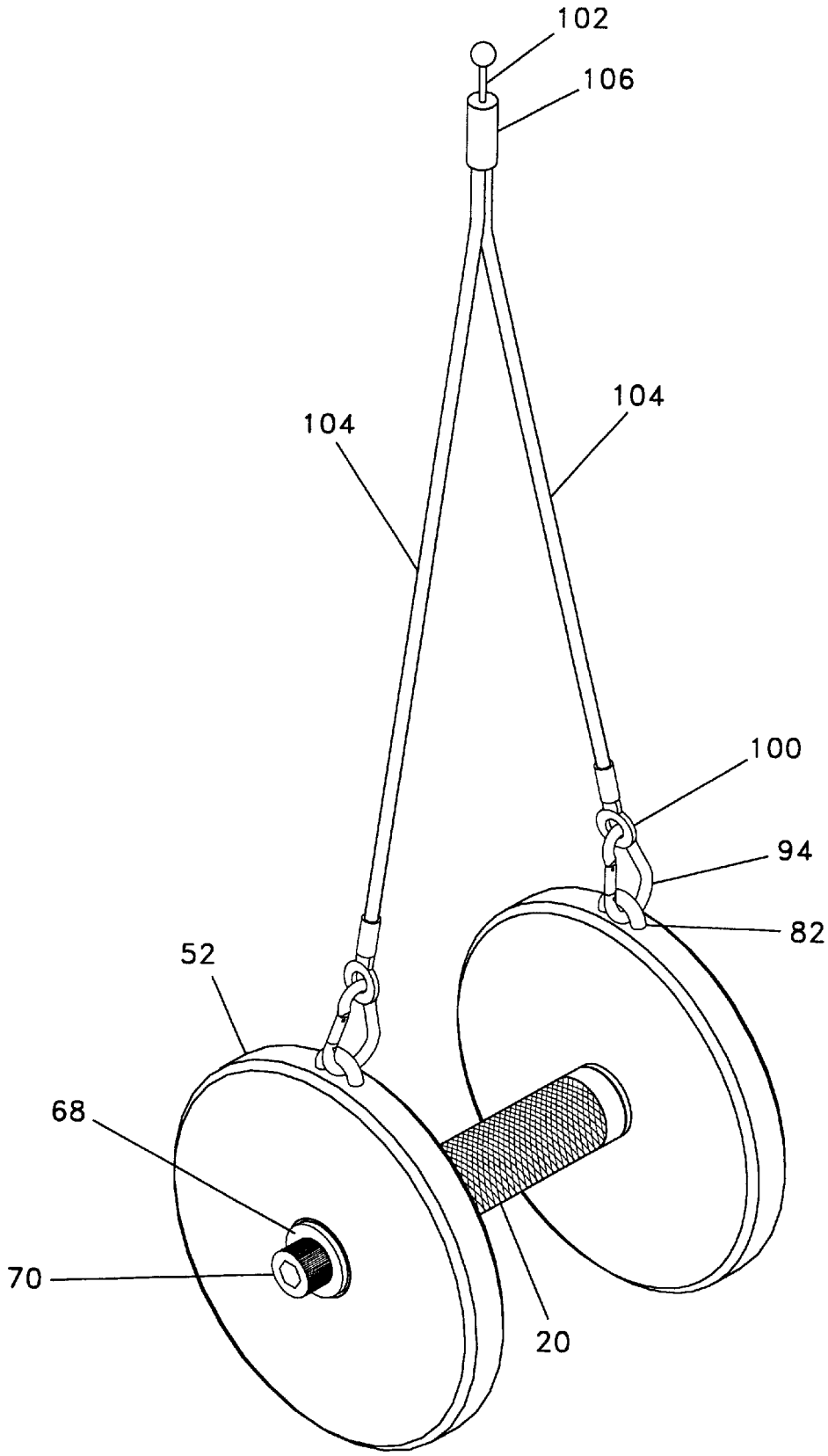
Fig. 2-D

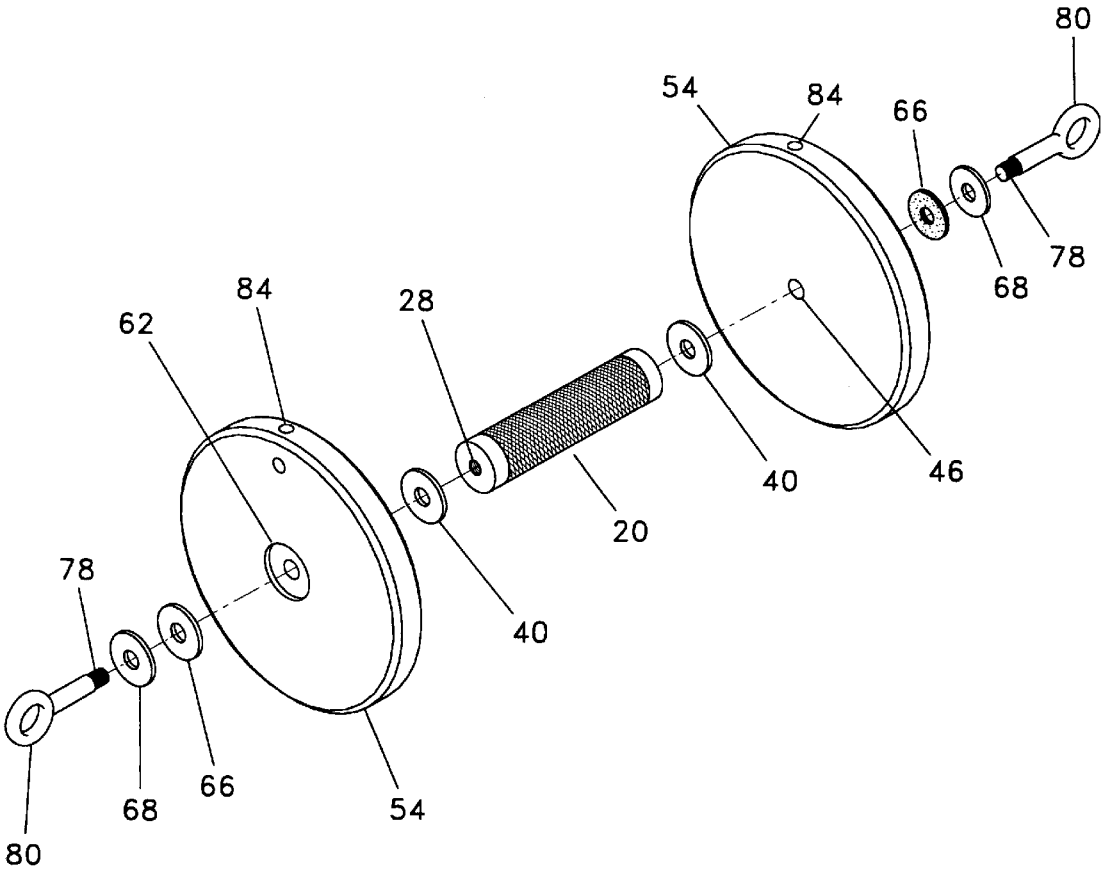
Fig. 3-A

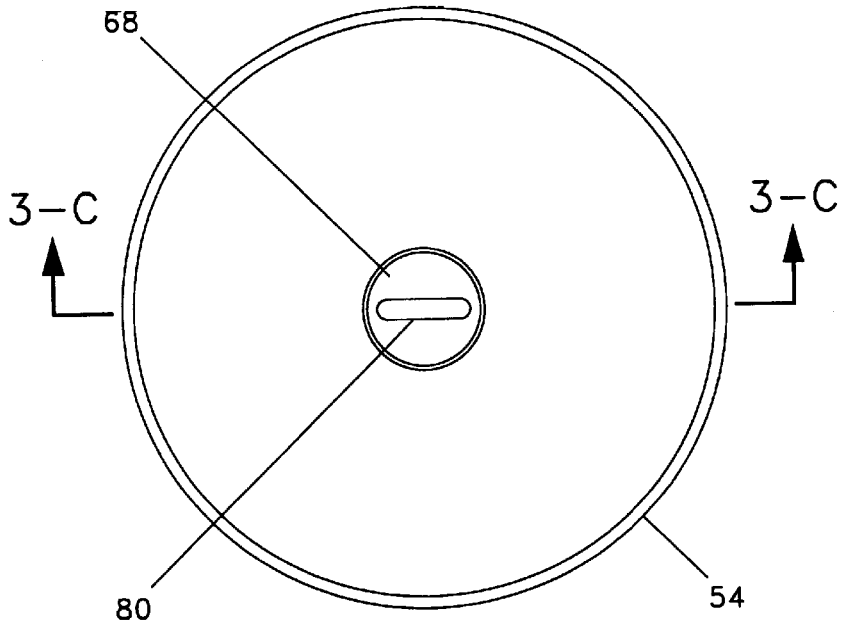
Fig. 3-B
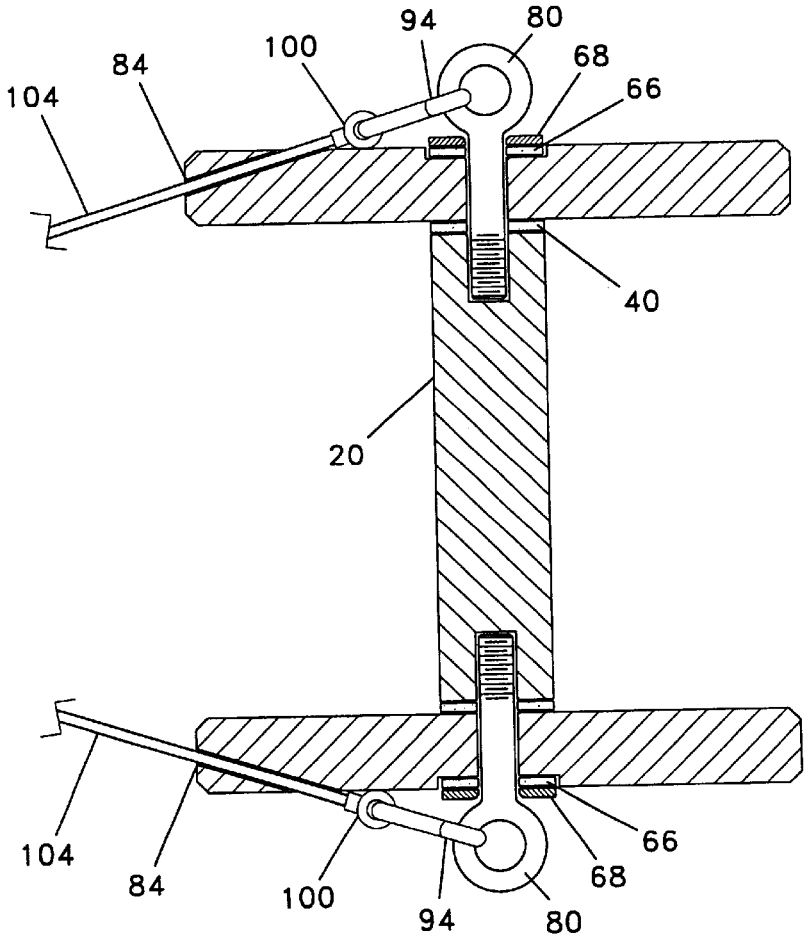
Fig. 3-C

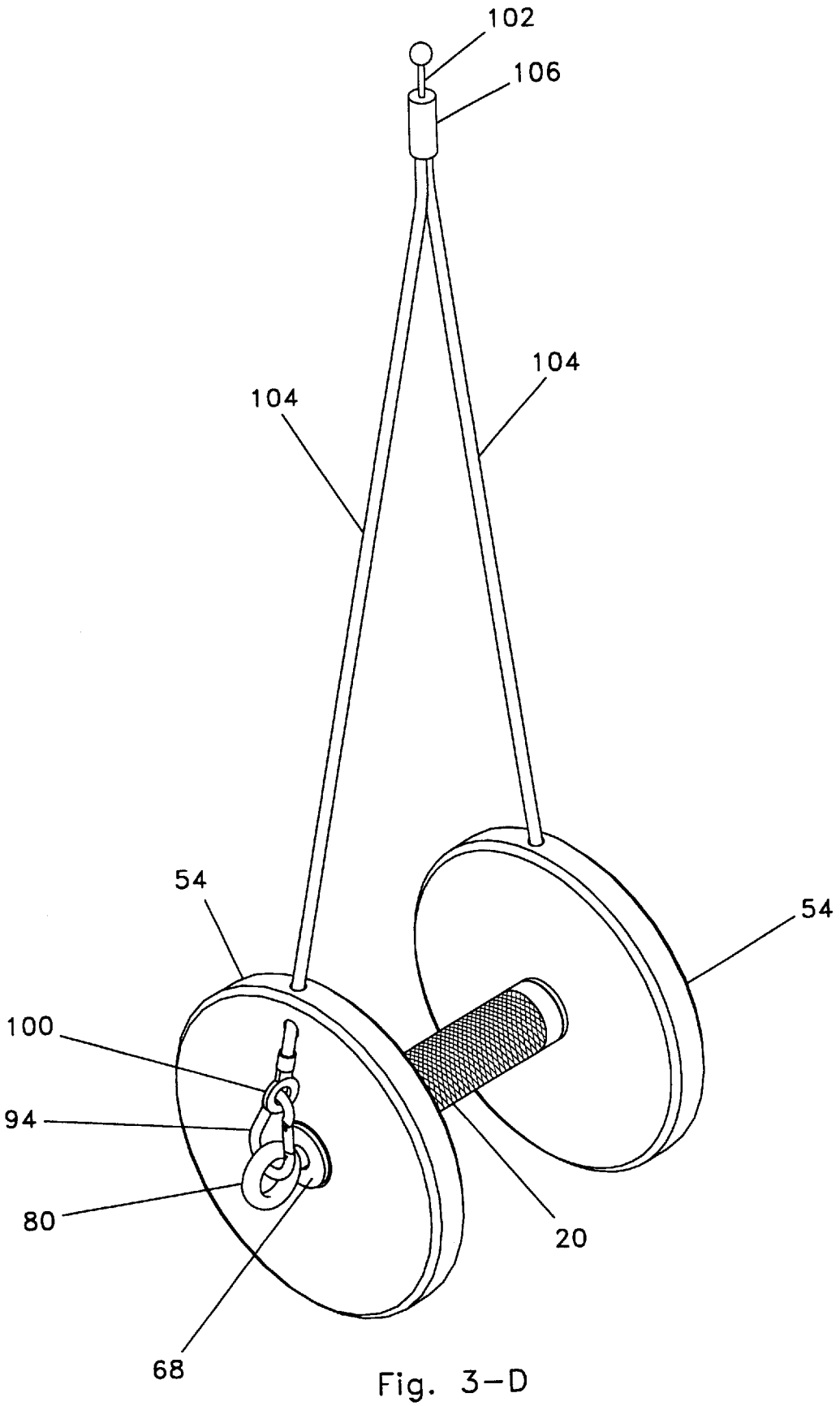
Fig. 3-D

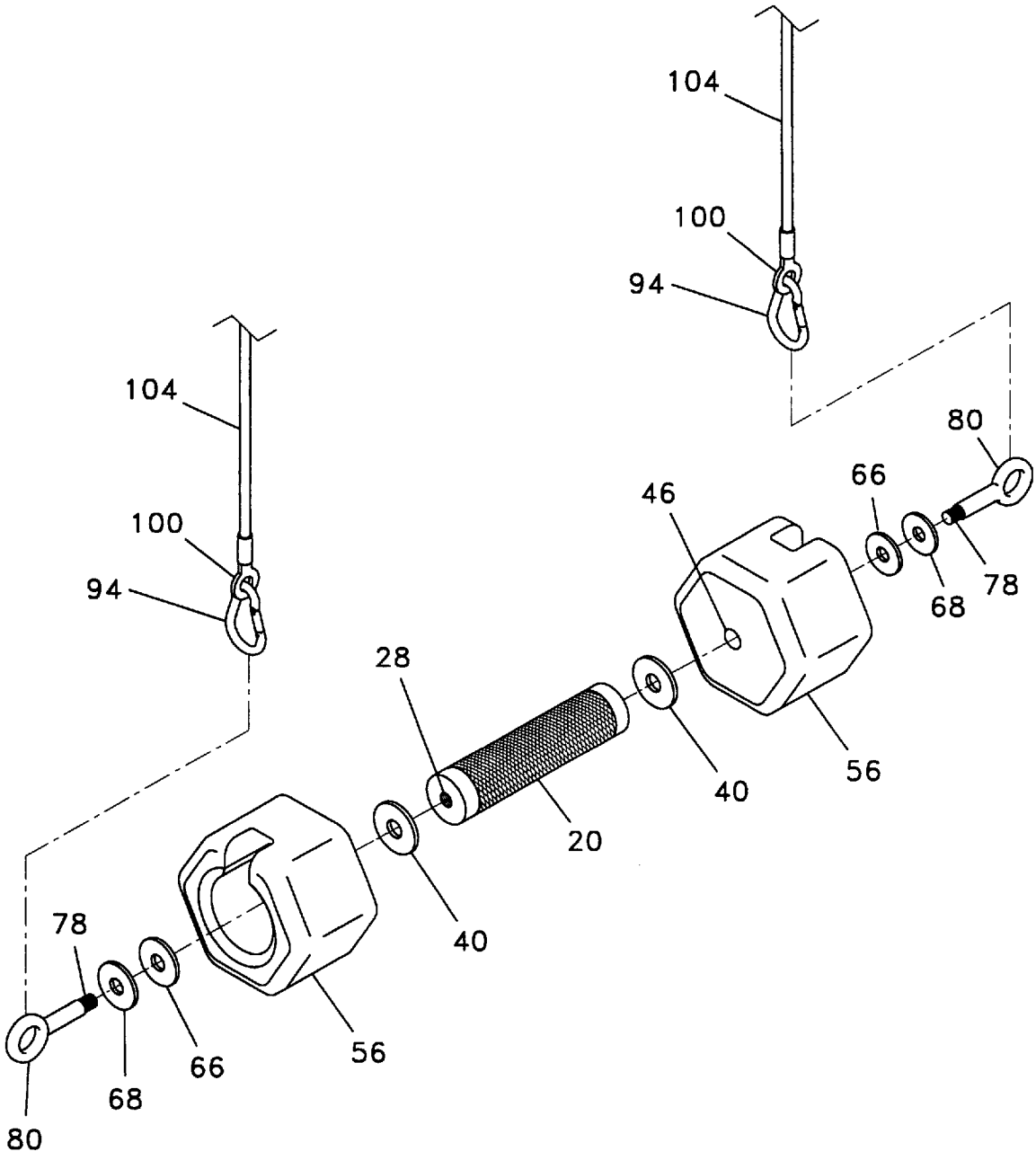
Fig. 4-A

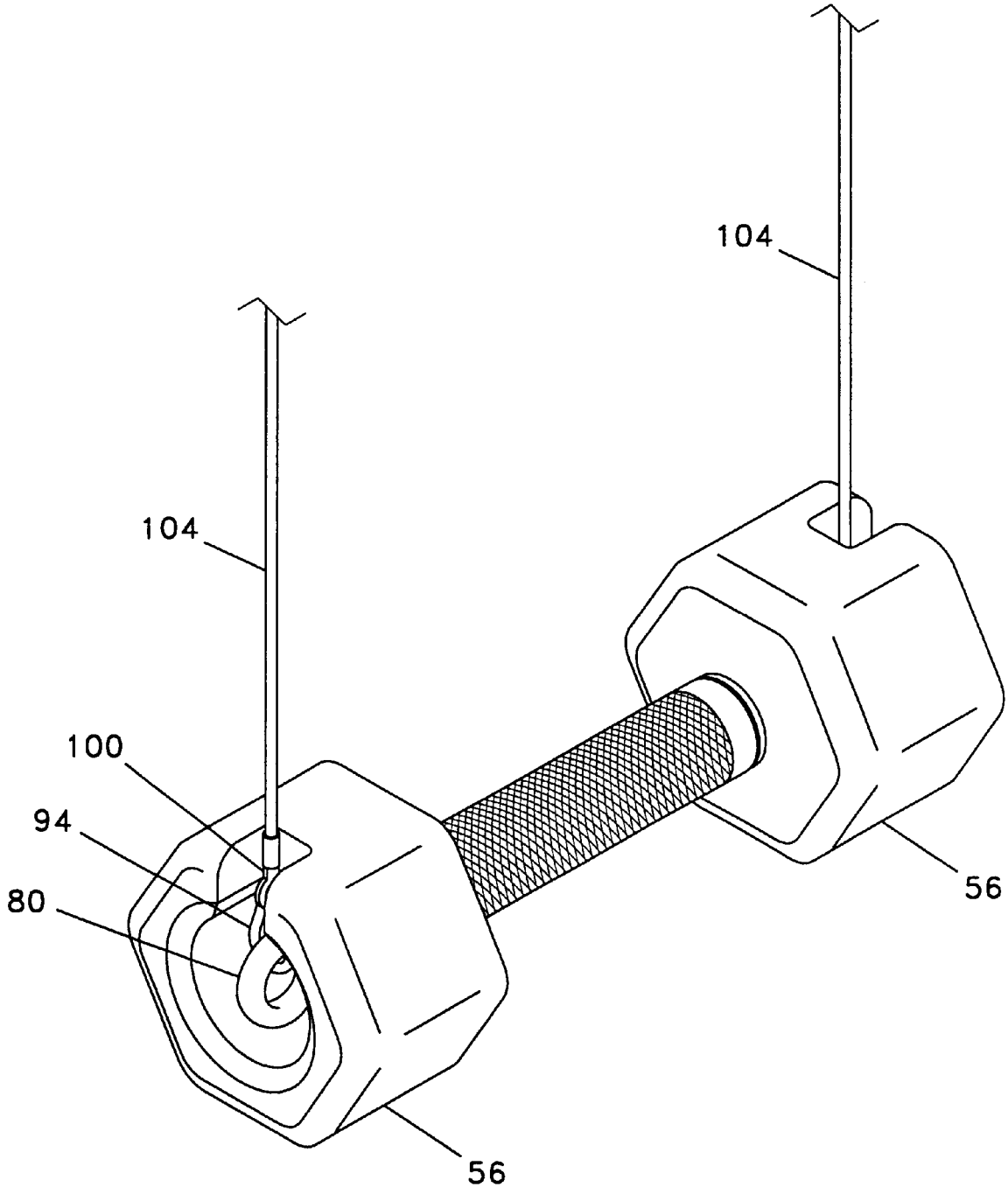
Fig. 4-B

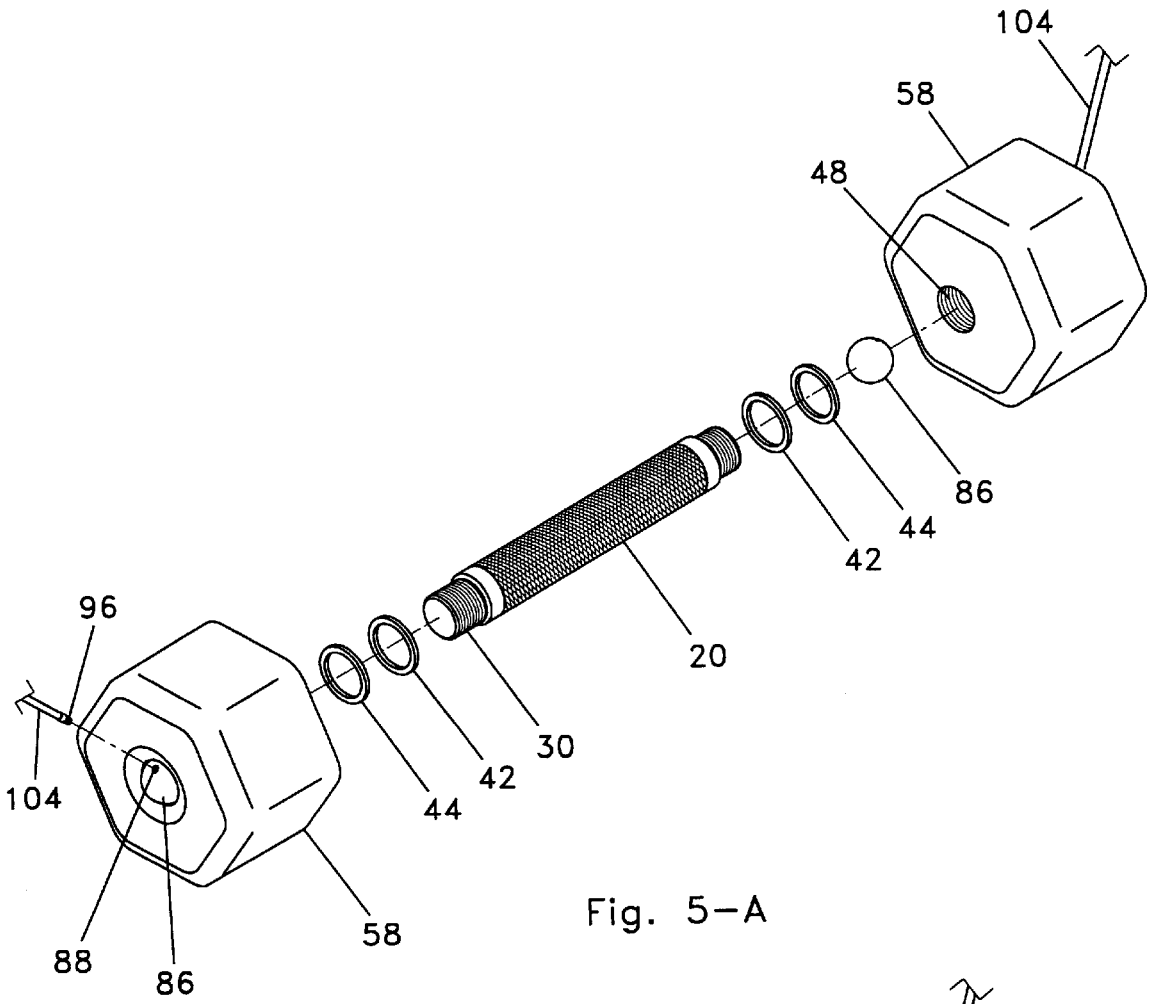
Fig. 5-A
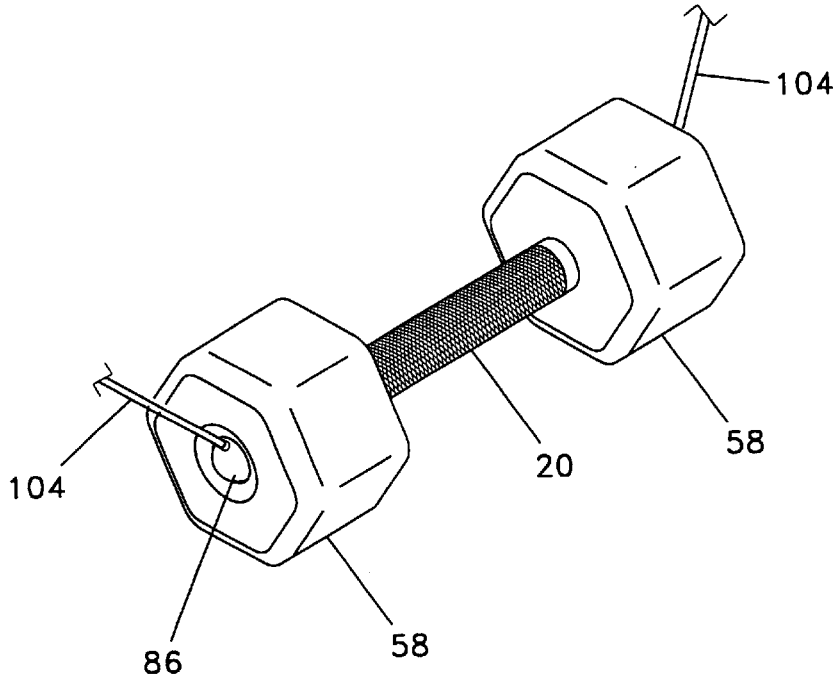
Fig. 5-B

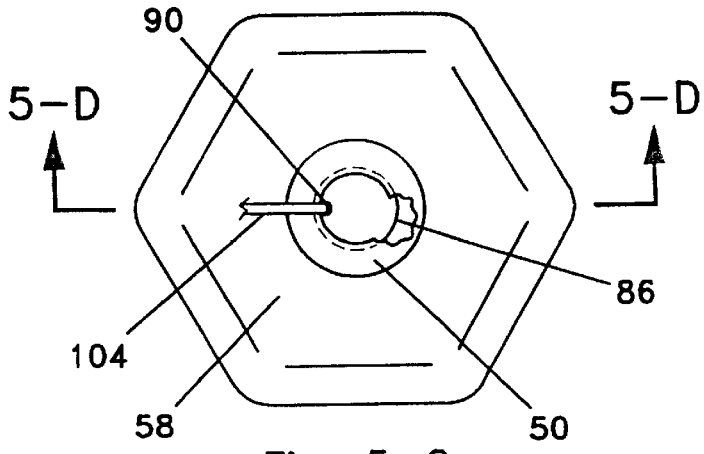
Fig. 5-C
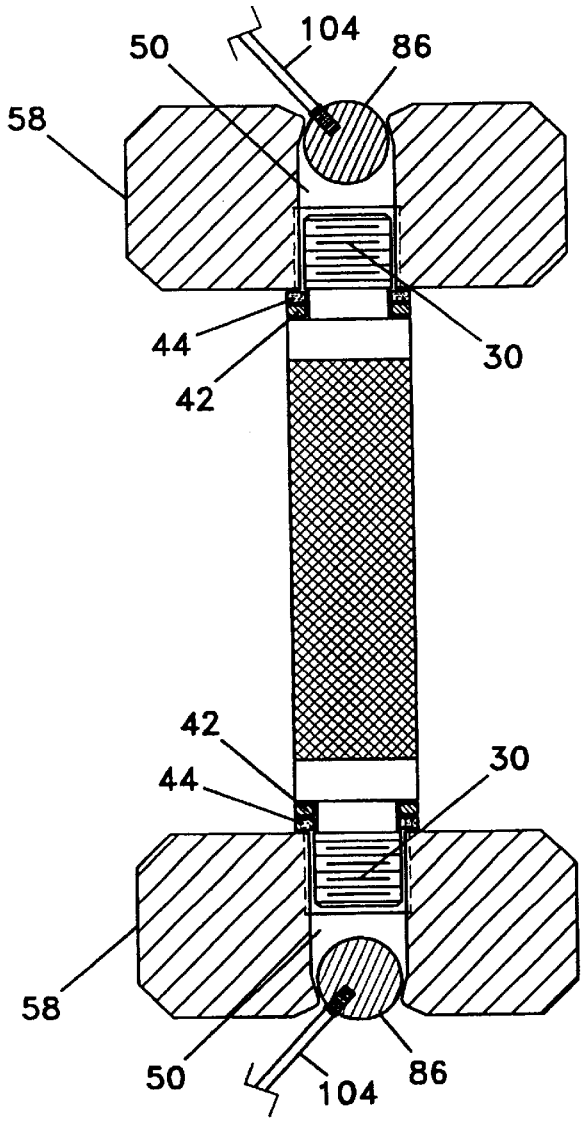
Fig. 5-D

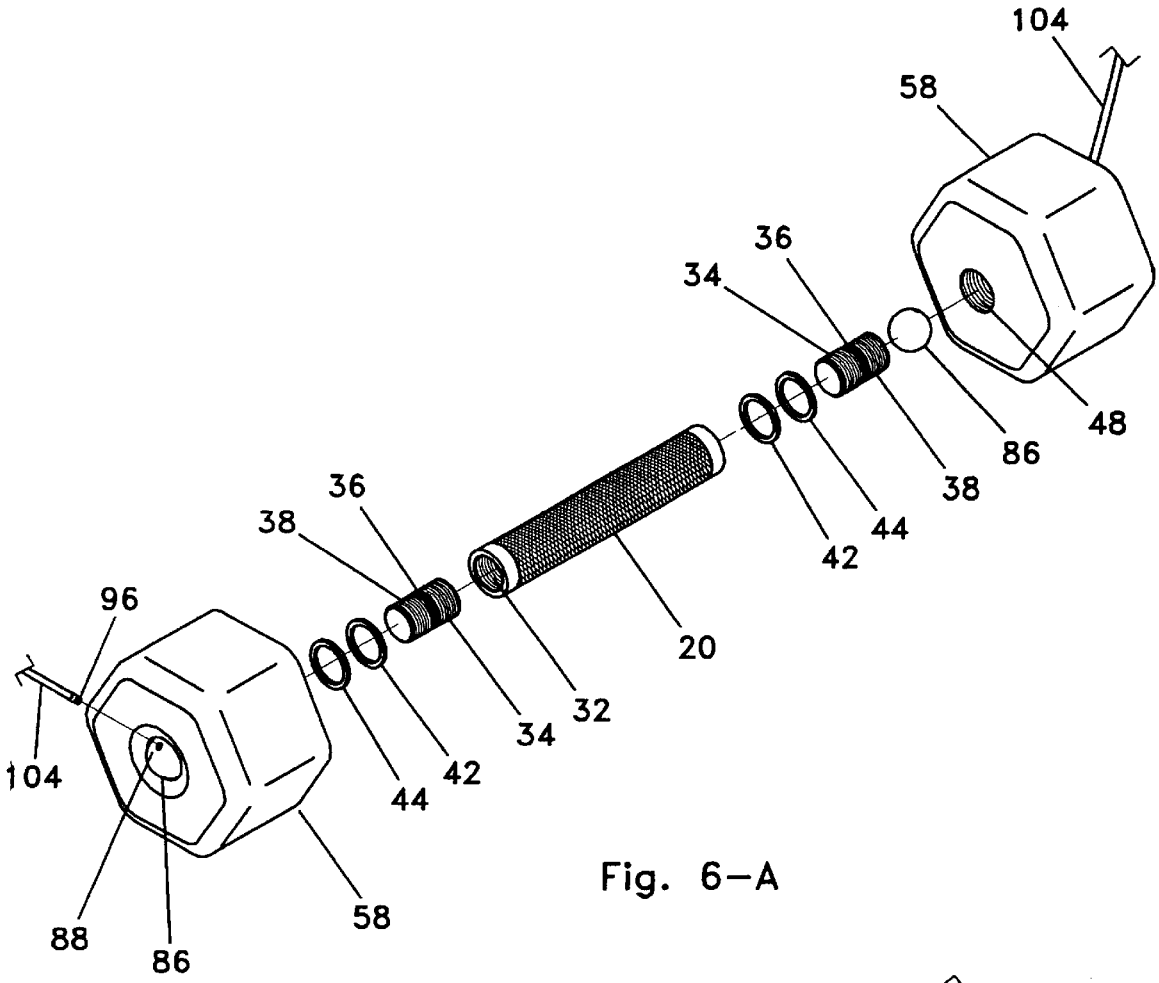
Fig. 6–A
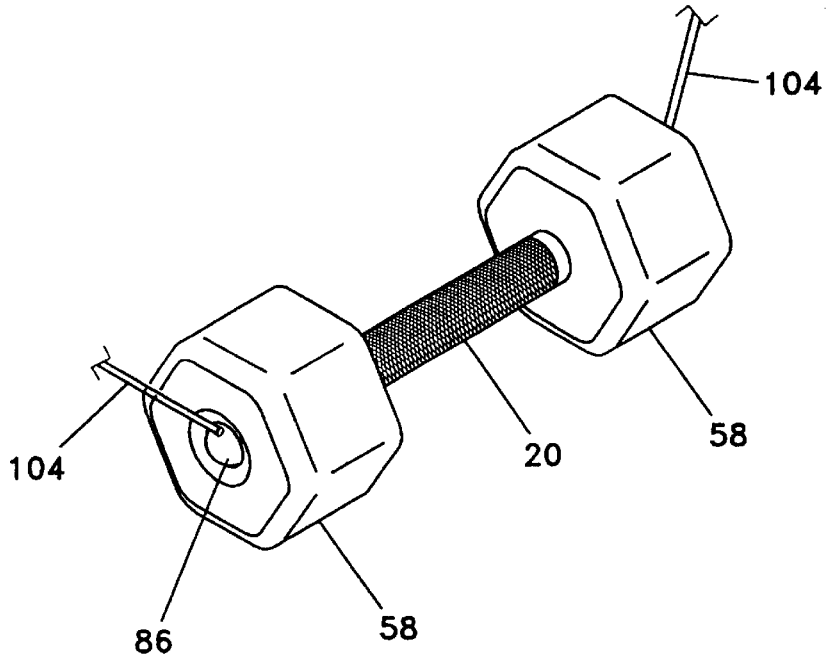
Fig. 6–B

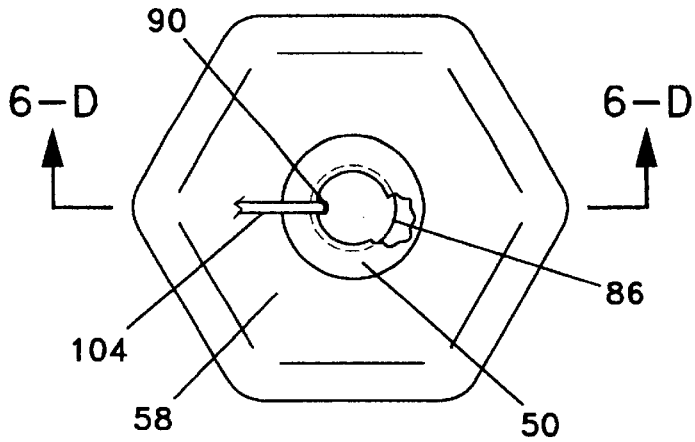
Fig. 6-C
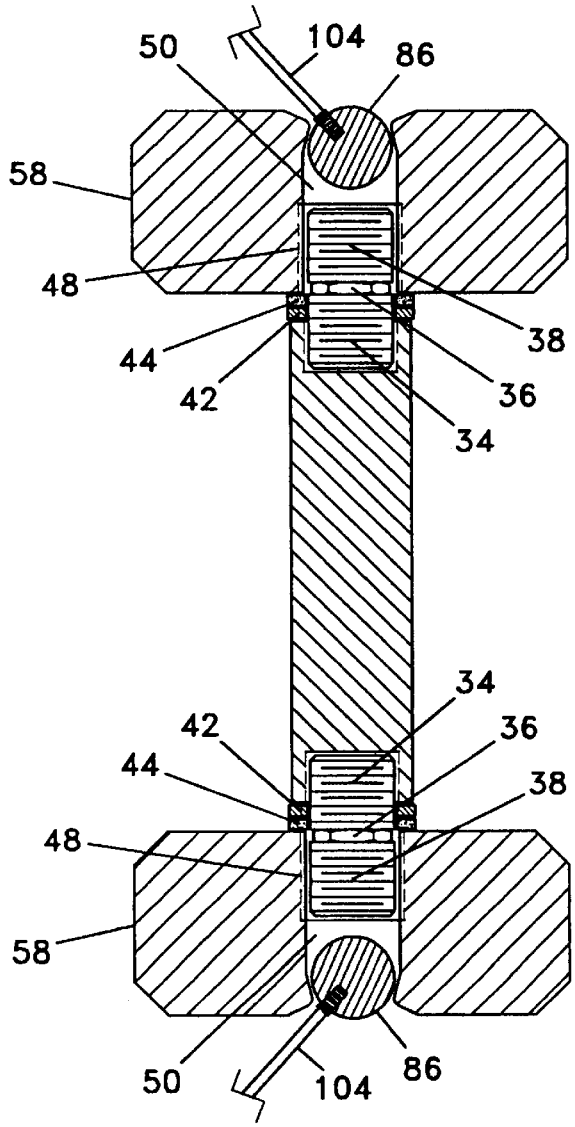
Fig. 6-D

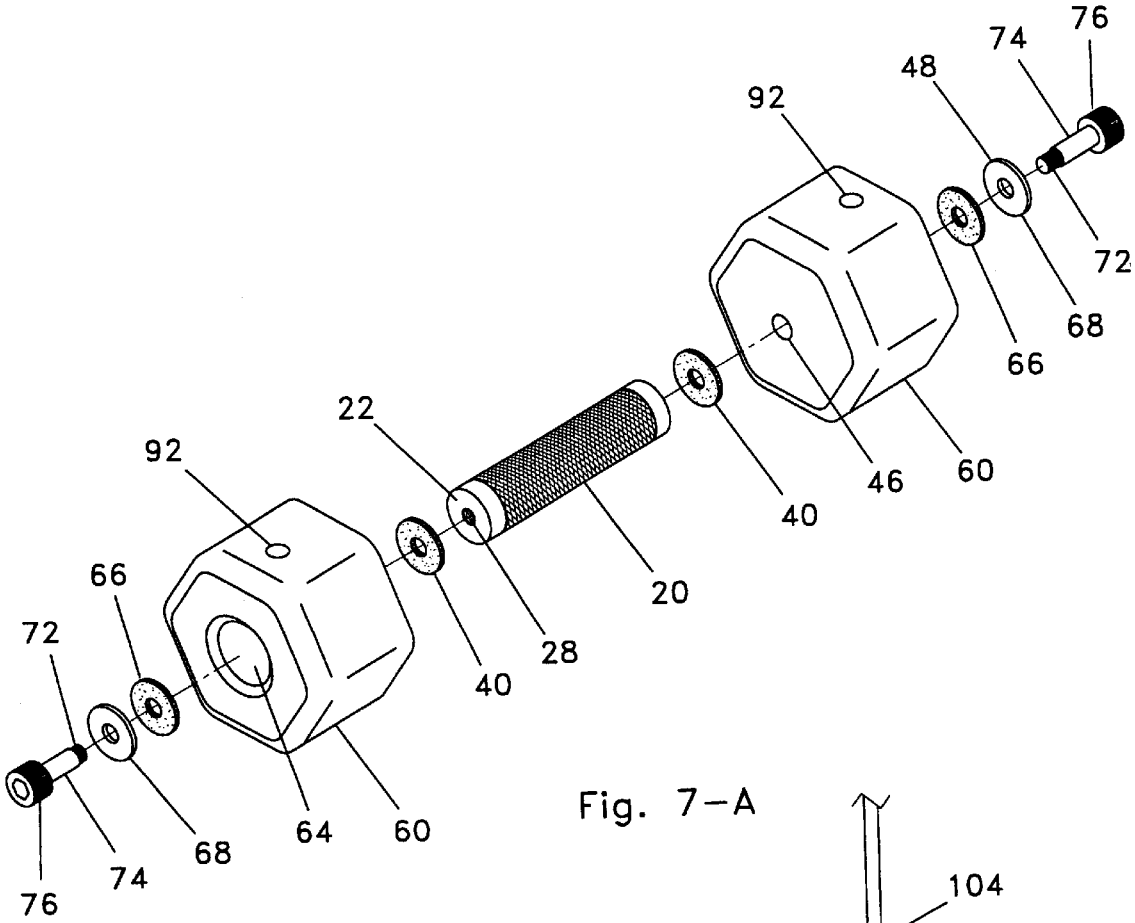
Fig. 7-A
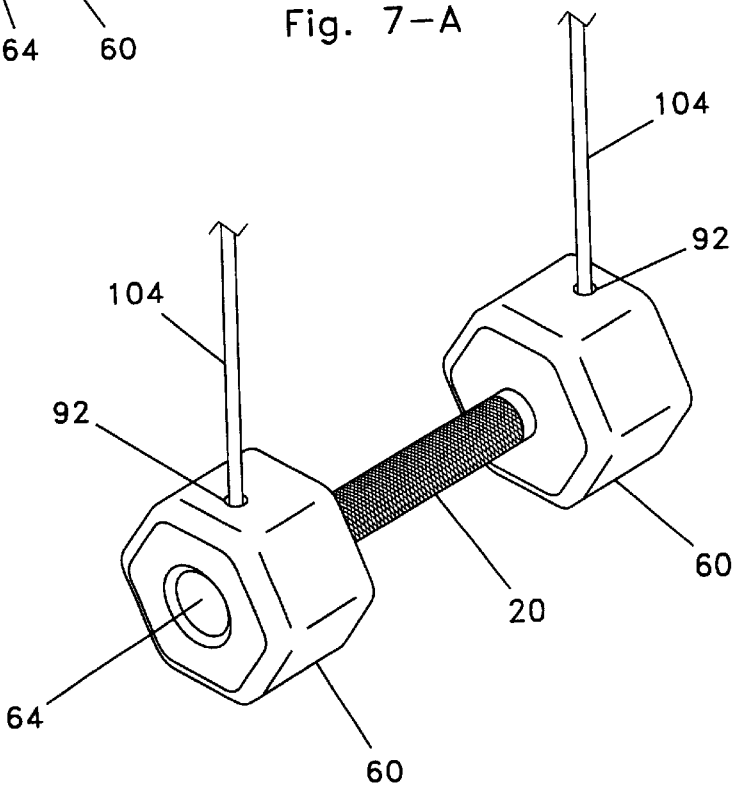
Fig. 7-B

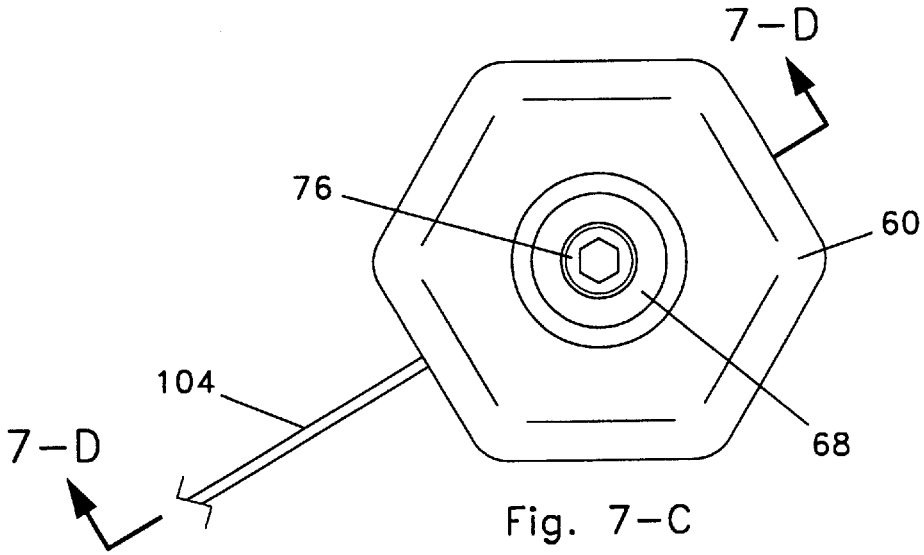
Fig. 7-C
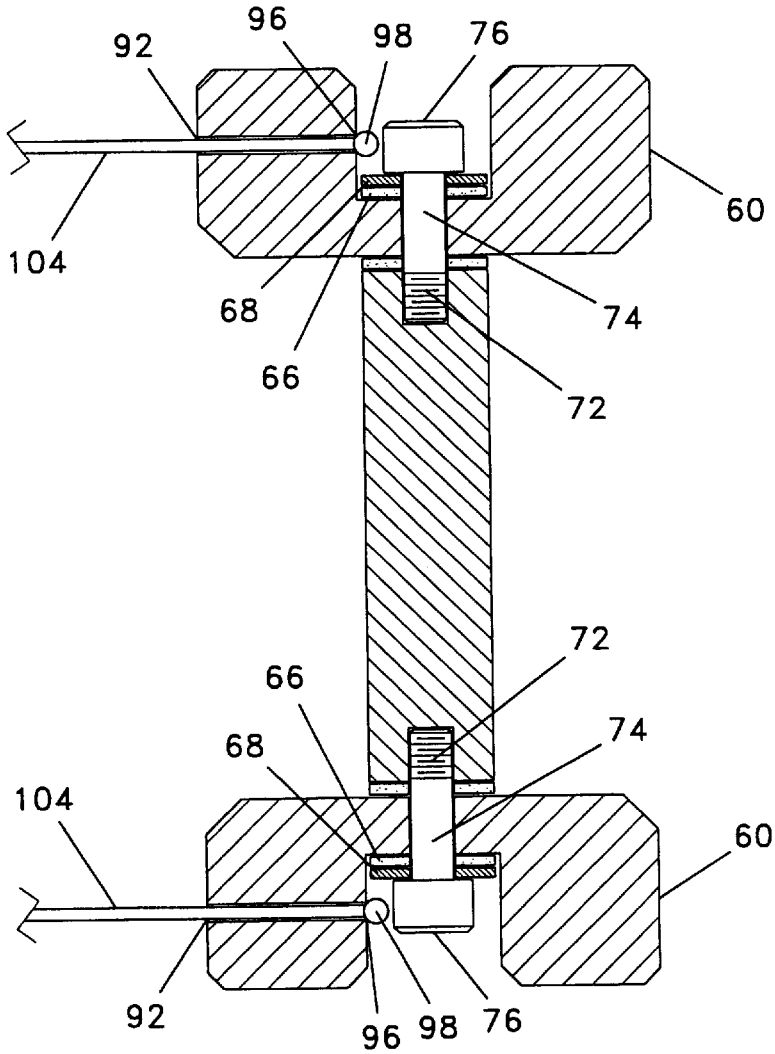
Fig. 7-D

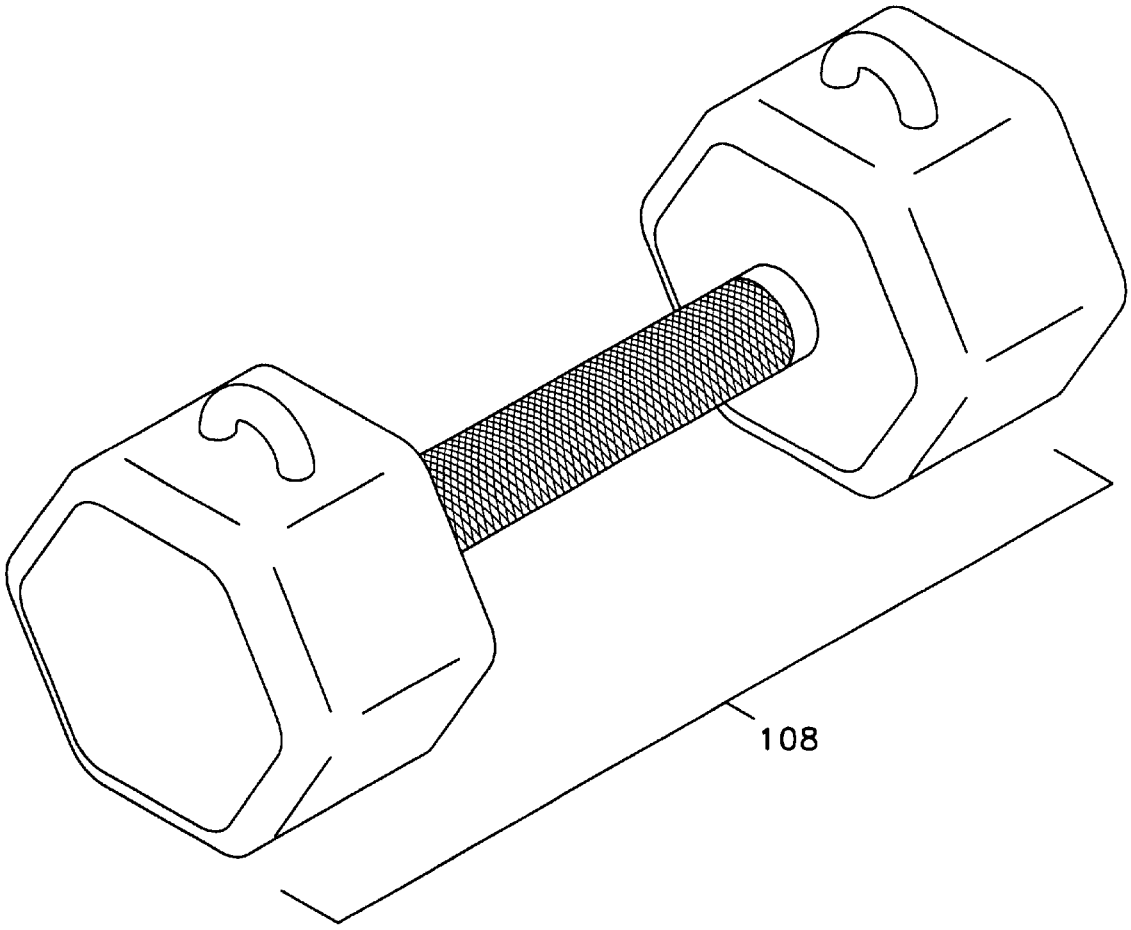
Fig. 8-A

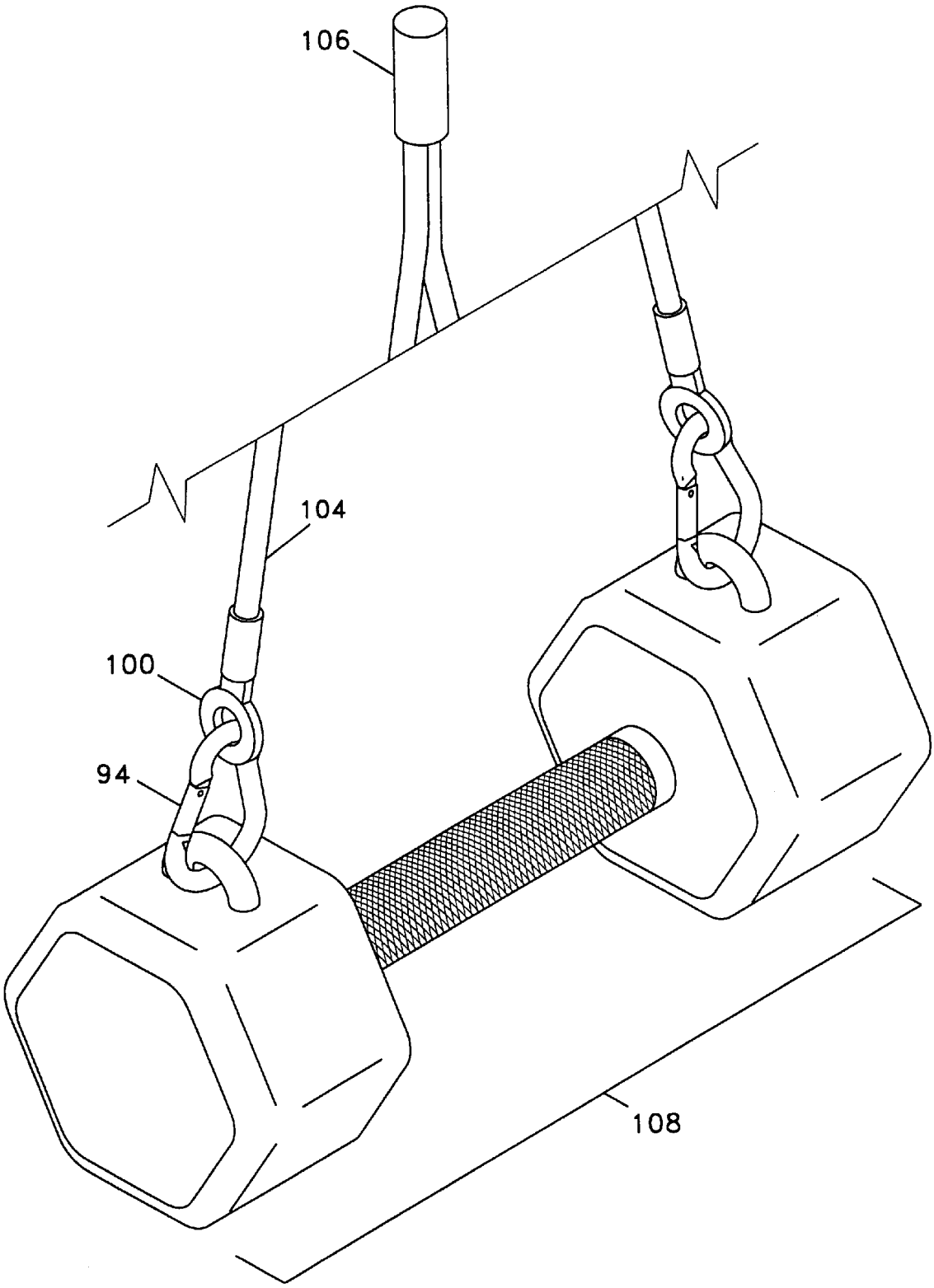
Fig. 8-B

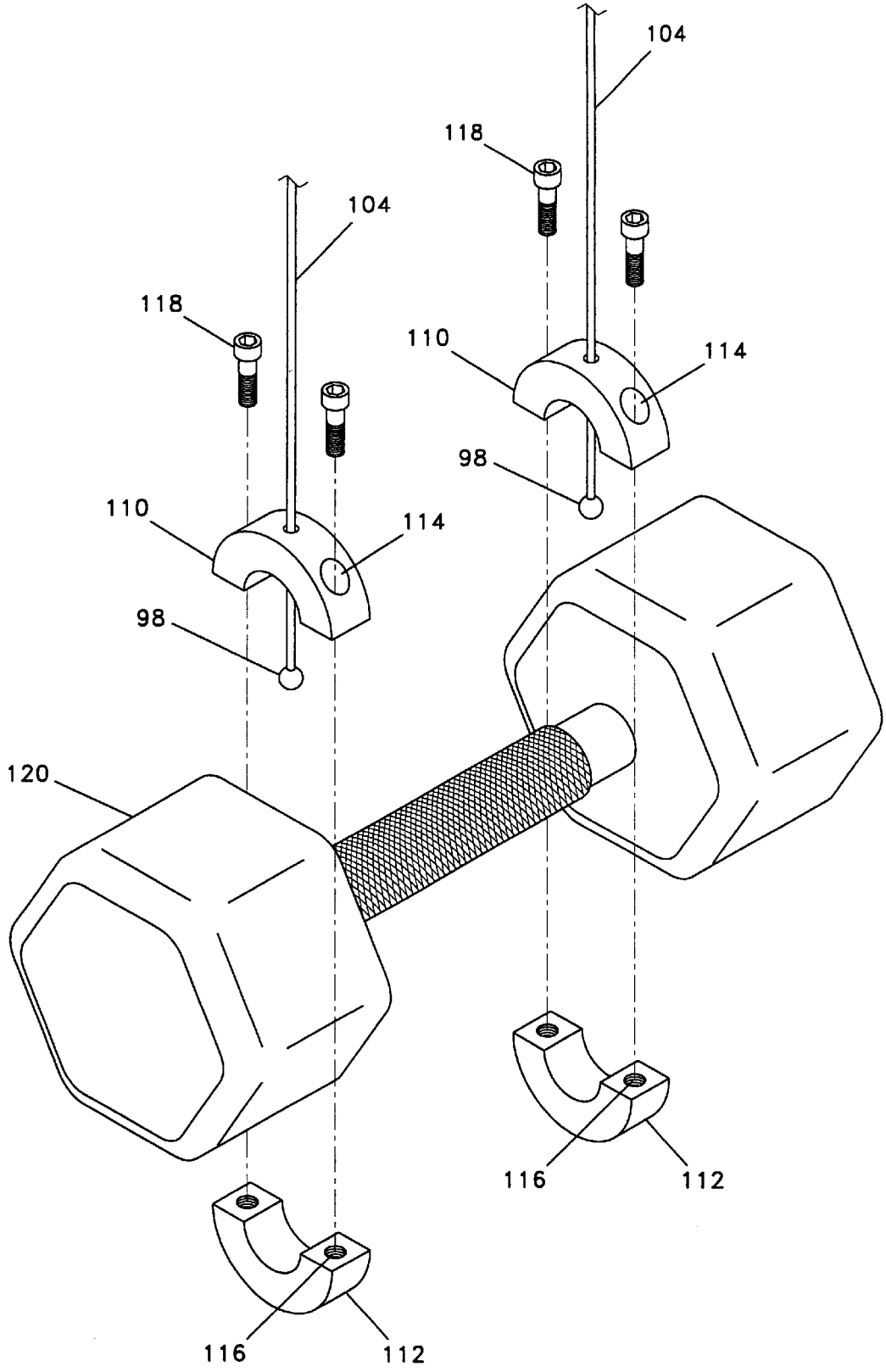
Fig. 9-A

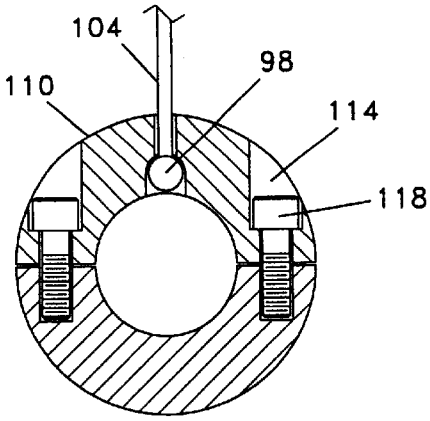
Fig. 9-C
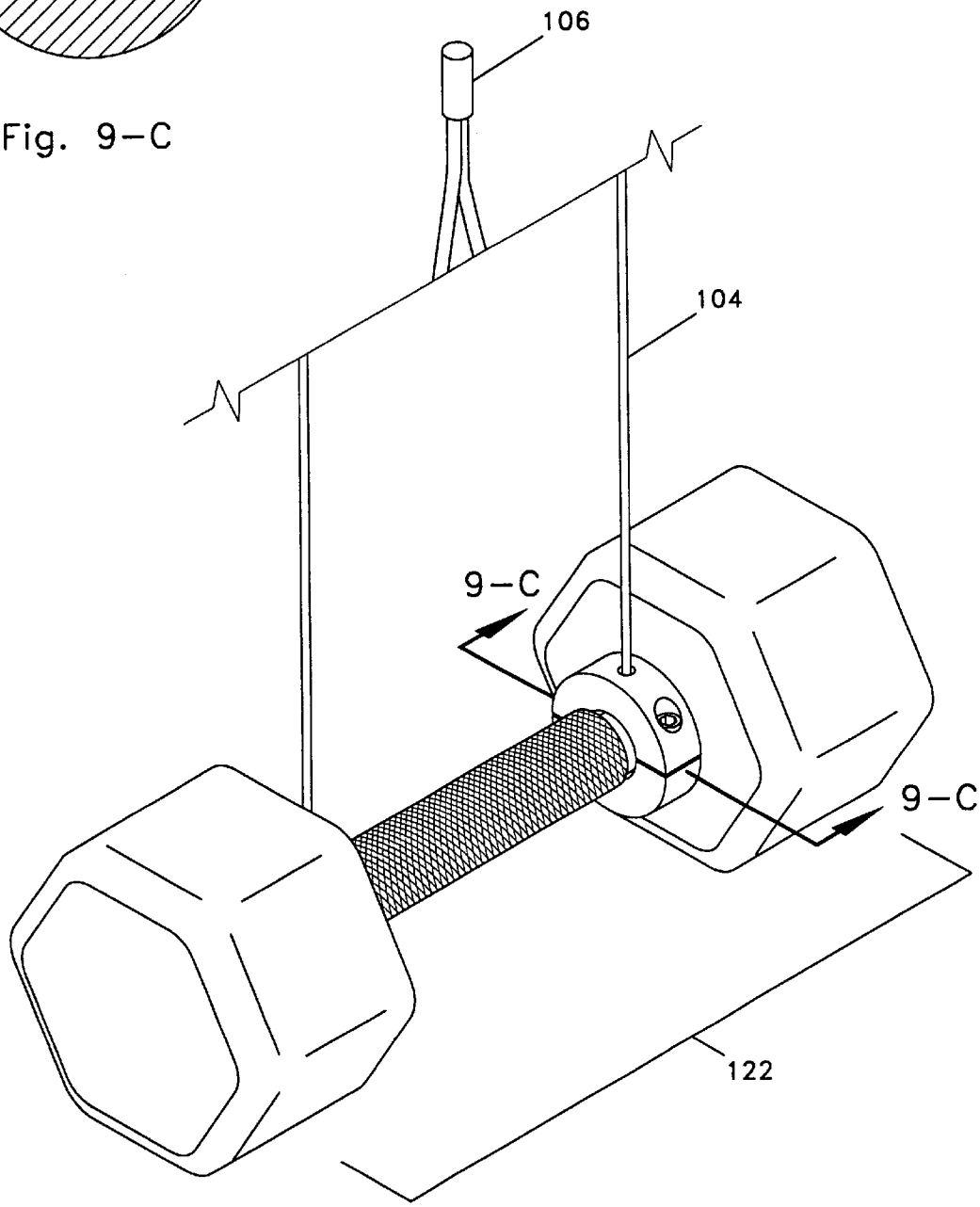
Fig. 9-B

CONVERGENT VECTOR RESISTANCE DEVICE

CROSS-REFERENCE TO RELATED APPLICATIONS

Not applicable

STATEMENT REGARDING FEDERALLY SPONSORED RESEARCH AND DEVELOPMENT

Not applicable

BACKGROUND OF THE INVENTION

1. Field of Invention

This invention relates to a method of resisting, human motion with two or more vectors of resistance converging upon a common unit of attachment, as well as equipment used to resist movement of the users muscular-skeletal system, particularly such equipment utilizing convergent force vectors.

BACKGROUND OF THE INVENTION

2. Description of Prior Art

Home and commercial gyms, fitness studios, wellness centers, athletic facilities, corporate health facilities rehabilitation and occupational facilities commonly supply resistance training equipment or more commonly called exercise equipment. This equipment, regardless of its location or structure, is generally used to oppose muscular contraction or rather provide resistance to a users movement whereby placing stress on the skeletal muscular system.

Therefore, muscles are stressed by moving body parts in contact with the resistance equipment having a magnitude selected by the user. This movement through a given range of motion usually follows a cycle often referred to as a exercise cycle that is repeated a number of times composing a set.

This equipment comes in many forms, shapes, and compositions. The following are examples of the most commonly encountered, or conventional equipment: Barbells, Dumbbells, plastic Tubing, Coiled Springs, Selectable-Weight-Stack Cable-Pulley-Systems, Cam-Regulated Selectable-Weight-Stack Cable-Pulley-Systems (also called variable resistance equipment), Hydraulic, and electronic Isokinetic equipment. These pieces of equipment have unique characteristics pertaining to their composition, shape, and function, but all of the above provide only one (1) vector of resistance to be manipulated.

The utilization of conventional equipment is limited to one vector of resistance or one action line and magnitude of resistance. Most equipment offers the option of altering, the magnitude of resistance but not the action line or vector of that resistance and therefore is limited in ability to function as a tool for resisting human motion. This may contribute to the reason users of the conventional equipment prefer to utilize a combination of equipment when applying force against muscular contraction. Unknowing to most, the reason for this is mainly attributed to the fact that using various exercise instruments will position body segments differently or otherwise varying equipment with different force vectors can challenge the body segments, further or in a safer manner, when in the presence of an injury.

Generally, users of this equipment rarely take the time to learn the fundamental characteristics of each piece of equipment, therefor unknowingly use equipment in a haphazard or contraindicated manner. Accompanying the ignorance of conventional resistance training, as related to skeletal and muscular adaptations, is an overall lack of understanding or misunderstanding how resisted motion affects the human body. Especially, on how body structures and articulations are impacted when introduced to force vectors, particularly the direction or action line and magnitude of such vectors. Moreover, many users learn vicariously or just imitated what is viewed causing a "monkey see monkey do phenomenon". Most often the monkey being viewed or demonstrating a particular exercise has little, if any, sound education in the body of knowledge pertaining to exercise, fitness, therapy, sports conditioning etc. Thus, the perpetual use of conventional equipment by users uneducated in a body of knowledge concerning resistance applied to human motion has numerous consequences. Due to the physiological responses of resistance training and potential side effects of improper positioning of resistance force vectors, understanding and education is as crucial here as it would be for a medical professional prescribing medications unknowing of the drugs origin or mechanism of action.

Further describing as an exercise cycle is performed through a range of motion (ROM) the magnitude of force placed in opposition to a specified muscle group, particularly its action line is unique to each type of equipment listed above. With this in mind, it can be understood that with one vector of resistance, the user will have to produce a specific sequence of events involving an array of structures specific to the direction of force or action line of resistance imposed by the equipment. Because of this, as muscles perform motion against each of the conventional forms of resistance, a unique bio-mechanical and physiological response occurs when presented with this exercise stimulus. In theory, with respect to utilization of above equipment for various purposes such as therapy, fitness, health and sports conditioning etc. each piece is limited in use by its specific nature and therefor able to elicit only a select few, if more than one, bio-mechanical and physiological responses. The response or change will depend upon how the user manipulates the equipment such as in the form or path of motion (POM) and the magnitude of resistance. Additionally, the response or change will depend on the users ROM and speed of movement (inertia), usually in terms of degrees per second in which movement occurs, as well as the total time force is applied against movement. Ultimately, each exercise instrument by its own is very specific thus having limitations in use. With this in mind, it becomes apparent that the internal stabilizing structures of specific movements will also be bound to the specific exercises performed and the limitations of conventional equipment.

It is believed that the magnitude of a force vector placed on a given muscle at a given time changes between and among equipment within the users prescribed ROM can be dangerous or counterproductive. This occurs when a given muscle's ability to create force is exorbitantly disproportionate to the opposing force vectors magnitude. The deleterious effects of over powering (resisting) muscular contraction can lead to serious injury of the involved musculature, joint, and bones or those stabilizing or supporting the primary action. Additionally, during the exercise cycle the muscles are capable of resistance force differently at various joint angles. Typically, at the joint angle, were the moment arm and resistance is greatest within a ROM, the largest number of motor units will be active. Generally speaking, with the previous particulars, cross bridging of the muscles filaments will also be greatest at the joint angle when the most number of motor units are active.

Furthermore, due to improper exercise intensities the use of conventional equipment often imposes counterproductive trauma upon involved articulations or joints and their respective bony levers. Moreover, this can be partially owed to the fact that to increase the potential likely-hood of enhanced physiological response most often the magnitude of resistance is increased in an effort to improve the stimulus to the muscular skeletal system. Typically this occurs when the muscle groups involved at specific points within the ROM feel unchallenged or conditioning levels have hit a plateau whereby the exerciser, desiring greater conditioning levels, increases the magnitude of resistance. This exemplifies the limitations of conventional equipment, particularly the absence of additional force vectors. In this situation at specific points within the ROM of an exercise cycle the resistance fails to challenge the muscle(s) of interest therefor the user, using equipment with only one force vector to manipulate, has to increases the magnitude of resistance in order to further challenge the muscular-skeletal system. As a result, the increased magnitude of force at certain positions throughout the range of motion can cause temporary or permanent damage to the structure or tissue of and around a given articulation, whether having a preexisting injury or being of sound structure prior to the exercise. Conversely, health, fitness, therapy, and human performance progress may be impeded if the magnitude of force, at any given point within the ROM, is inadequate in resisting movement of the user. This occurs when the resistance doesn't challenge the user and results in hindrance of progression and an undesired physiological response to the resistance training, conditioning, or therapy modality An example of conventional equipment is the barbell, dumbbell, or more generally speaking a free-weight. Free-weights have one (1) vector of resistance with the resulting action line directed straight toward earth, dictated by the earth's gravitational pull on all objects. Free-weights come in a plurality of magnitudes and the user has to choose the one that best fits the exercise and goal of the user. The most apparent disadvantage is that the vector of resistance regardless of magnitude will direct any free-weight toward the earth, thus following the action line of gravity. As this free-weight is used, only a few specific positions in the ROM provide enough resistance in opposition to a given muscles force vector or it's action line throughout the exercise cycle. This can cause serious implications when trying to match the potential force of muscles with that created by lifting free-weights especially for those compromised by a previous injury or individuals in rehabilitation not yet ready for free-weight exercise training.

Consequently, in a given position, as the involved bony levers of the exercise cycle decrease or increase joint angle the resistance force will contribute less to the rotation of the bony levers and more to linear distraction or compression of the involved articulation and it's elements. Additionally, free-weights maximally tax or stress muscles at specific degrees of joint angle associated with a given articulation dependent upon body position.

Another device of conventional equipment is tubing, which provides a single force vector that increases as one end is stretched from the other. This is, of course, owed to its elastic properties and offers an ever-changing magnitude of force until stretched beyond the elastic capabilities and plasticity is encountered. Because of the elastic properties of tubing the increasing and decreasing magnitudes of force often poorly match the capabilities of muscles opposing or controlling movement when attached to this apparatus. The magnitude of this force vector will continue to increase even when the muscles' ability to create force decreases. Furthermore, as is the problem with the conventional equipment listed above and below, the vector created by stretching one end of the tubing from the other provides only one action line to be manipulated.

Similar in resistance characteristics to tubing is spring resistance, which also behaves in a manner by which one end of the spring is repositioned a greater distance from the other causing an increase in resistance to movement in that direction. The magnitude of the force vectors created using spring resistance behaves similar to the above mentioned tubing. This equipment also suffers from many other disadvantages such as its limited capabilities, bulkiness, makeshift construction, and overall misconception of operation.

Cable-pulley equipment with selectable weight stack provides only one vector force, respective to its attachment on the body and where the cable intermingles with the last pulley in the series of pulleys starting at the weighted stack. In many exercise positions, the resistance magnitude of this equipment poorly matches that which can be created in opposition by muscle force. This disproportion like that found when using free-weights can have numerous deleterious effects on structures of the musculo-skeletal system, and articulations and therefor has limited uses.

Cam-regulated pulley equipment, being an extension of the cable pulley systems, is very expensive to manufacture and places a enormous demand on the resources used for its' construction. Furthermore, respective to above mentioned sentence the equipment is too expensive to purchase for most individuals. This type of exercise equipment requires much space and is specifically designed to oppose muscular contraction of only one or two muscle groups, thus limited in useful possibilities. Additionally, this equipment is very heavy and therefor hard to move or reposition.

Another device used to challenge the muscular skeletal system is hydraulic exercise equipment, which in the general sense is similar to Isokinetic Equipment in that the apparatus typically moves, when manipulated by the user, at a given speed though it's range of motion. In addition to being bulky, expensive, and single-use equipment provisions of resistance occurs only to the concentric contraction of the involved muscles, therefor being completely inadequate for achieving certain physiological responses.

Last of all, Isokinetic Equipment, which has several barriers to proper use. First and foremost, this equipment is, generally speaking, the most expensive per unit. Further restricting is the space required to store and use Isokinetic Equipment. In addition to these unfavorable conditions, the equipment generally requires some sort of power source for its' operation. It is further limited by the skill one needs to operate this equipment Its most apparent use is testing and measuring specific force capabilities of involved musculature at various speeds of movement.

Equipment made available for use thus far does not make available more than one force vector to be manipulated and as such is at a distinct disadvantage. New equipment developed recently provides more than one vector of resistance but completely overlooks the significance of various directions of these force vectors as exemplified in U.S. Pat. No. 5,891,004 to Berry (1999) that offers a crude yet feasible example of coupling two vectors of resistance. Berry specifically addresses the attachment of tubing to a Olympic bar for the purpose of adding greater magnitudes of force to the equipment thus increasing resistance as the end of tubing attached to equipment is repositioned further from the other end. This invention adds a vector of resistance, matching the same direction as the vector of the bar, further promoting concerns and problems associated with overloading the skeletal and muscular systems.

Similar equipment from the last decade, and referred to in above patent to Berry, which makes variable resistance available by adding another vector of resistance is U.S. Pat. No. 5,029,849 to Nurkowski (1991) are very complicated and involve multiple steps for production and assembly. Additionally, this equipment is interconnected in makeshift fashion that creates a burden for changing equipment between exercise cycles and among individuals. Nevertheless, all equipment used to resist human motion heretofore known suffer from a number of disadvantages:

(a) Conventional equipment is bulky, therefore making most of the equipment hard to reposition for use with numerous muscle groups, and makeshift construction, of some equipment, burdens the user when changing equipment to match the needs of various muscle groups.

(b) The connection and disconnection of resistance equipment, having a force vector, to other equipment with force vector qualities is tedious, time-consuming, and restricting.

(c) If one uses a hydraulic type of equipment, resistance will oppose only concentric contractions of the skeletal muscular system. Which doesn't challenge or benefit muscles contracting eccentrically.

(d) Recently developed equipment requiring the specific use of tubing for one of the two force vectors opposing muscular contraction utilize a common linear direction of resistance or, in other words, both resistance vectors follow the same action line. Conversely, the action line of the involved muscle(s) as well as the muscle(s) strength capabilities is often mismatched in this situation.

(e) Conventional equipment having a singular vector of resistance offers only one change option (weight change) for providing resistance in opposition to muscular contraction. Because there is only one vector of resistance, the user has only one choice when challenging the muscular skeletal system.

(f) If one uses a selectorized weight machine, typically that machine supporting the user in many directions will dictate the path of motion the applied body-part will follow. This requires less effort from the stabilizing musculature when compared to exercises performed absent from rigid supporting structure and thus requiring the skeletal muscles to contract in an effort to brace the skeletal structure. Ultimately, specific internal stabilizing mechanisms would not have to work as hard if external structures are present and capable of supporting the body segments in a given position.

(g) Much of the equipment used today is excessively large for easy and convenient storage.

(h) Generally much of the equipment used to resist human movement is very expensive therefor being, confined for only those having the finances to purchase or gain access to this equipment.

(i) The equipment of present is limited to use for strength and conditioning purpose for which single direction vector resistance is applied in opposition of user motion.

(j) Equipment available to the general public rarely provides any, much less accurate, information about the risks, benefits, or procedures of utilizing such equipment.

(k) Some equipment requires electrical power to function properly, causing another expense and barrier to use.

(l) Conventional equipment provides therapeutic capabilities limited to that provided by a single action line having a limited number of uses.

(m) Some limitations that further obstruct usage are the complexity encountered when changing equipment among exercises in order to conditioning other muscle groups.

SUMMARY

In accordance with the present invention a method and a device for use with dumbbells, barbells, handles, or bars to provide a common connection of a plurality of force-vectors. The device comprising an object of predetermined size and weight having an attachment process for a handle, and an attachment process for an exercise instrument or articles of equipment having force vectors.

OBJECTS AND ADVANTAGES

Accordingly, besides the objects and advantages of the equipment described in my above patent, several objects and advantages of the present invention are:

(a) to provide a device which can be repositioned so that numerous exercises can be performed.

(b) to provide a device that can be easily attached and detached to different handles, dumbbells, barbells, or bars of various weights so that magnitudes of convergent force vectors can be changed independently.

(c) to provide a device that can be used to challenge or stress the muscular system while performing concentric, eccentric, and isometric contractions.

(d) to provide a device which offers the ability to change resistance load on a given muscle by the choices and positions of numerous vectors of resistance afforded by the connection of the invention to an exercise instrument such as a cable-pulley system or elastic tubing.

(e) to provide a device that is less restrained to any particular path of motion, therefore facilitating involvement of stabilizing musculature when moved throughout an exercise cycle.

(f) to provide a device which is compact and easy to store after use.

(g) to provide a device which is inexpensive to manufacture.

(h) to provide a device and method which can be used for numerous strength and conditioning protocols.

(i) to provide a device which can be utilized in, an educational format, to promote and enhance knowledge pertaining to human movement against resistance.

(j) to provide a method of resisting human movement without requiring an electrical power source.

(k) to provide a device which can be used as a therapeutic modality and having a therapeutic purpose.

(l) to provide a device which affords simple application of other force vectors when exercising various muscle groups.

Further objects and advantages are to provide an economical device that can be used by individuals, which places forces on the muscular-skeletal system, by providing a common place of attachment for a plurality of force vectors. Thus providing numerous options for the method and device to be used for therapy, sports conditioning, and general exercise use. Still further objects and advantages will become apparent from a consideration of the ensuing description and drawings.

DRAWING FIGURES

In the drawings, closely related figures have the same number but differ in alphabetic suffixes.

FIGS. 1A to 1D shows various aspects of a device, having a handle with threads, and further depicting parts unconnected, also illustrating attachment to exercise instruments by half circles fixed to plates.

FIGS. 2A to 2D shows various aspects of a device, where a socket heat screw is used to connect the device together.

FIGS. 3A to 3D shows multiple aspects of a device utilizing an eyebolt for the connection of the device and the attachment to other exercise instruments.

FIGS. 4A to 4B shows a similar device with an eyebolt providing connection of individual parts and containing a cutout of the plate for which the lanyard can pass by and secure to the eyebolt.

FIGS. 5A to 5D shows a device with hexagonal plates that are threaded onto the handle following the insertion of a swivel socket into the plate, which will provide a source of connection to other exercise equipment.

FIGS. 6A to 6D shows a similar device with the alteration consisting of the connection method between plate and handle which is depicted by a bridgeable threaded rod that screws into the handle and the plate.

FIGS. 7A to 7D shows a device that connects plates to handle by a socket head screw also having a hole in the plates for which a lanyard can pass through and be secured to the device.

FIGS. 8A to 8B shows a device in a solid casting version.

FIGS. 9A to 9C shows a apparatus that is made out of rigid material and is placed on to conventional equipment, in this case a hexagonal dumbbell.

REFERENCE NUMERALS IN DRAWINGS

Figure 10:
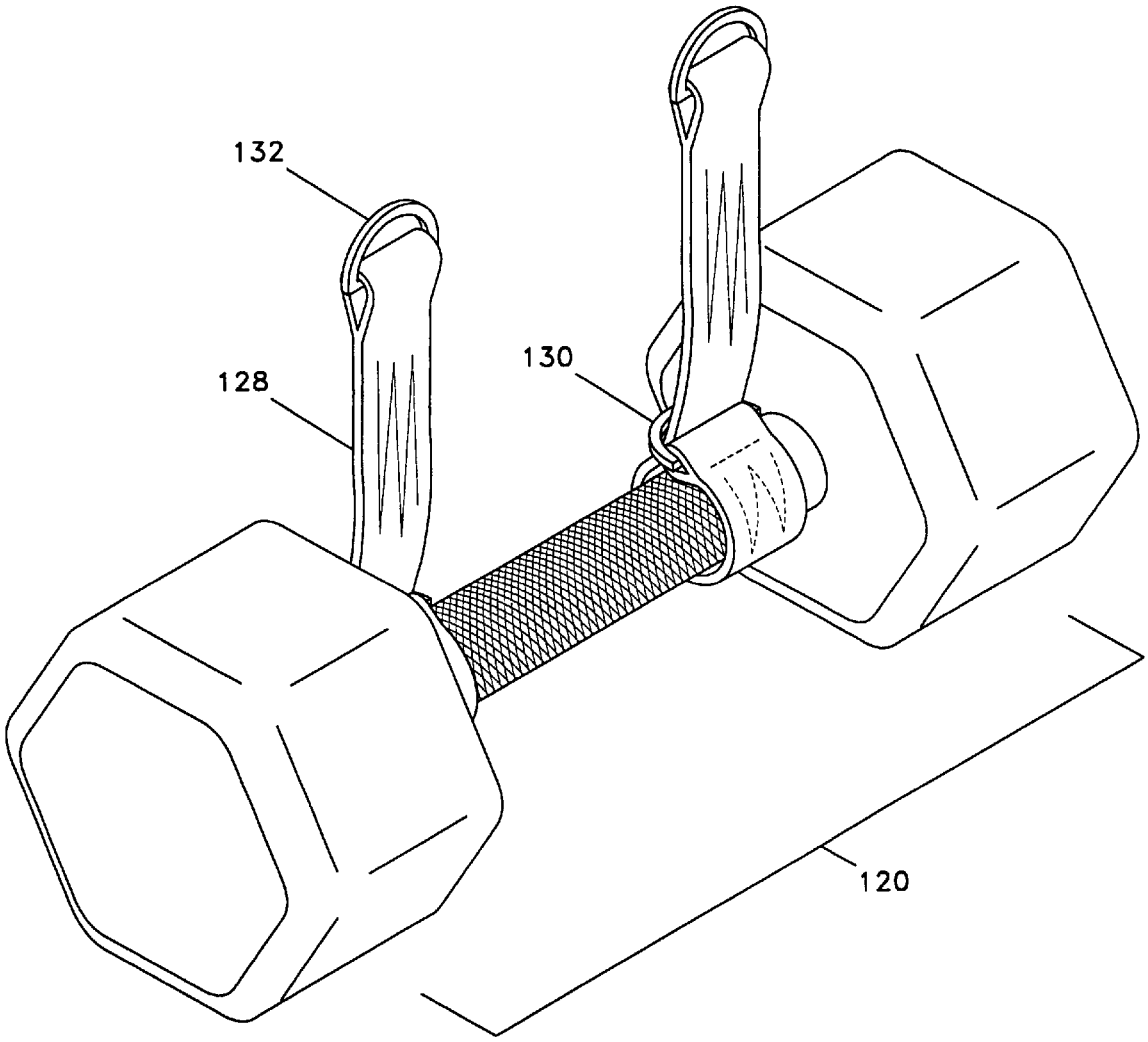
FIG. 10 shows a apparatus that is made out of flexible material and is fastened to a handle of conventional equipment such as in this figure a conventional hexagonal plated dumbbell.

| | |
|---|---|
| 20 | knurled handle |
| 22 | smooth handle bulkhead |
| 24 | smooth spindle |
| 26 | small external threaded end |
| 28 | small threaded hole |
| 30 | large external threaded end |
| 32 | large threaded hole |
| 34 | handle-side exterior threaded rod |
| 36 | lockdown nut |
| 38 | plate-side exterior threaded rod |
| 40 | plastic washer |
| 42 | plastic thin washer |
| 44 | metal thin washer |
| 46 | round plate center through hole |
| 48 | hexagonal plate threaded hole |
| 50 | hexagonal swivel socket foramen |

-continued

| | |
|---|---|
| 52 | round plate |
| 54 | round plate with edge through hole |
| Convergent Vector Resistance Device and Method | |
| 56 | hexagonal plate with cutout |
| 58 | hexagonal plate |
| 60 | hexagonal plate with top opening |
| 62 | counter-bore |
| 64 | hexagonal plate foramen |
| 66 | plastic washer |
| 68 | metal washer |
| 70 | socket head cap |
| 72 | socket head screw exterior thread |
| 74 | shaft |
| 76 | socket head screw |
| 78 | eyebolt external threads |
| 80 | eyebolt |
| 82 | half-ring |
| 84 | diagonal though hole |
| 86 | swivel socket |
| 88 | threaded-hole of swivel socket |
| 90 | lanyard and swivel socket connected |
| 92 | hexagonal plate though hole |
| 94 | spring clip |
| 96 | crimped threaded link |
| 98 | metal-ball |
| 100 | crimped ring connector |
| 102 | common lanyard crimped ring connector |
| 104 | lanyard |
| 106 | common lanyard crimp |
| 108 | solid casting |
| 110 | top half-ring |
| 112 | bottom half-ring |
| 114 | top half-ring through hole |
| 116 | bottom half-ring threaded hole |
| 118 | socket screw |
| 120 | standard dumbbell |
| 122 | dumbbell attached to apparatus |
| 124 | cable-pulley apparatus |
| 126 | human animation |
| 128 | flexible strapping |
| 130 | large D-ring |
| 132 | small D-ring |

DESCRIPTION—FIGS

Preferred Embodiment

FIG. 1A is a exploded isometric view of my invention. The device having a knurled handle 20 with surface sufficient for gripping that has on its ends a smooth handle bulkhead 22 which serves as a bulkhead for parts placed adjacent to it. A smooth spindle 24 protruding longitudinally from handle FIG. 20 and having a small external threaded end 26 which has a plastic washer 40 that is passed over and positioned against 22. Additionally, the device has a round plate 52 including a half ring 82, and a round plate center through hole 46 which is positioned onto 24 and placed adjacent to washer 40. Plate 52 has a counter-bore 62, which accommodates a plastic washer 66 at its adjacent surfaces. Furthermore, a metal washer 68 is positioned over 26 and 24 and adjacent to 66, also having a socket head cap 70 attached to 26 and positioned adjacent to 68 securing the assembly of the device. Ultimately, elements of the preferred embodiment are made of rigid material such as steel. However, the elements can be made of any material such as plastic, rubber, metal, and other common or exotic materials so that shape will not be distorted when external force is applied to it or the underlying intention of the invention is not sacrificed.

FIGS. 1B and 1C are views showing the device and individual parts connected together. FIG. 1B shows an end view while FIG. 1C is a partial cross-sectional view of the device FIG. 1D is perspective view detailing an intermediary attachment device that will connect the invention to an exercise instrument. This apparatus includes a spring clip 94 connecting 82 to a crimped ring connector 100 on a lanyard 104.

This lanyard is attached to the other lanyard arising from the other round plate by a common lanyard crimp 106. From this lanyard crimp arises a common lanyard crimped ring connector 102 which ultimately end in a connection by another quick link to an exercise instrument such as a cable-pulley machine or resistance tubing.

FIGS. 2–9—Additional Embodiments

Additional embodiments are shown in FIGS. 2,3,4,5,6,7, and 8 wherein each case the device is shown connected and disconnected in its elements with a multitude of parts in a variety of shapes and sizes. In FIG. 2A the handle contains a small threaded hole 28 through which is exposed at smooth handle bulkhead 22. Following in reverse order of connection as the preferred embodiment excluding entirely parts 24 and 26, a socket head screw 76 having a shaft 74, and a socket head screw exterior thread 72 is placed though 68,66,52,40, and screwed into 28.

FIGS. 2*b* and FIG. 2*c* are perspective views showing the device and individual parts connected together. FIG. 2B shows an end view while FIG. 2C is a cross-sectional view of the device. FIG. 2*d* is a perspective view of the assembled and connected version of the additional embodiment similar to view 1*d* of the preferred embodiment.

FIG. 3A is an embodiment similar to that found in FIGS. 1*a*–1*d* as well as the previous. Alterations include a eyebolt 80 having a eyebolt external threads 78 that passes centrally through a round plate with edge through hole 54 an diagonal through hole 84. The connection of the device is the same as the previous embodiment with the exchange of the socket screw for the eyebolt. The through-hole allows the lanyard to pass through the plate and attach to the eyebolt by spring clip 94 device described in the preferred embodiment and shown in FIG. 1*d*. FIG. 3*b* is an end view, while FIG. 3*c* is a cross-sectional view with the lanyards attached to the eyebolts. FIG. 3*d* is a perspective view of the attachment.

FIG. 4A is a perspective view of an exploded assembly similar to the previous embodiment. This embodiment has a hexagonal plate with cutout 56 and is connected to the handle by the eyebolt just like the previous embodiment. FIG. 4B is a perspective view of the device connected together and attached to the lanyards by the spring clips.

FIG. 5A is the exploded assembly view of an additional embodiment consisting of handle 20 and a hexagonal plate 58 with a hexagonal swivel socket foramen which houses a swivel socket 86 having a threaded hole of swivel socket 88. The handle having a large external threaded end 30 is secured to hexagon plate 58 by screwing it into a hexagonal plate threaded hole 48. Frictional wear of handle and plate is hindered by a plastic thin washer 42 that is adjacent to the handle, and a metal thin washer 44 which can be placed adjacent to the plate. The device utilizes an intermediary for connection and is attached to another exercise instrument by a crimped threaded link 96, which is attached to lanyard 104. FIG. 5B is a perspective view of the invention connected by the individual parts. FIG. 5C is an end view showing a lanyard and swivel socket connection 90 and FIG. 5D being the partial cross-sectional view of 5C, illustrating the internal components and the connection of individual parts.

FIG. 6A depicts an embodiment similar to that shown in views 5A–5D. However, this embodiment details a large threaded hole 32 in the handle. Connecting hexagonal plate 58 to handle 20 is a plate-side exterior threaded rod 38 and a handle-side exterior threaded rod 34 separated and connecting the two together in the middle by a lockdown nut 36. The remaining parts being the same as those in the previous embodiment. FIG. 6B is shown as an assembled perspective view followed by FIG. 6C and FIG. 6D of an end view and cross-sectional view respectively.

An additional embodiment is displayed in FIG. 7A, which is in exploded assembly view This device has a small threaded hole 28 in the handle that accepts socket head screw exterior thread 72 of socket head screw 76. This socket head screw has shaft 74 that is placed through metal washer 68 and then through plastic washer 66 which is then adjacent to the previous washer as well as a hexagonal plate with top opening 60. In hexagonal plate with top opening 60 there is a hexagonal plate foramen 64, through which the socket head screw can pass, and once through the plate can pass through plastic washer 40 and screw into the handle thereby connecting the plate to the handle. Plate 60 has a hole 92 that allows lanyard 104 to be passed through it and into the space created by hexagonal plate foramen 64. From here a metal ball 98 is screwed onto crimped threaded link 96 whereby attaching the lanyard to the device. FIG. 7B is a perspective view of the connected version illustrating the lanyards fixed into the holes. FIG. 7C and FIG. 7D are end and cross-sectional views respectively.

FIG. 8A is a perspective view of an additional embodiment pertaining to a solid casting 108 of the device. FIG. 8B is a perspective view of this device attached to lanyards that will ultimately be connected to another exercise instrument.

FIGS. 9–10—Alternative Embodiments

There are numerous possibilities with regard to relative disposition and shape of the apparatus and its parts, as illustrated in FIGS. 9 and 10, which presents perspective exploded, cross-sectional, and assembled views.

FIG. 9A is an exploded assembly view of an alternative embodiment. This apparatus utilizes the lanyard as an intermediary by passing it through a top half-ring 110 thereafter being secured by metal ball 98 that is positioned onto the lanyard as described in previous FIGS. 7A–7D. Adjacent to top half-ring 110 a bottom half-ring 112 is positioned and secured to it by passing a socket screw 118 by a top half-ring through hole 114 and tightening the socket screw into a bottom half-ring threaded hole 116 in bottom half-ring 112 is a perspective view showing a dumbbell attached to apparatus 122 and the lanyard for the eventual connection to an exercise instrument. FIG. 9C is a cross-sectional view of the apparatus held together by the socket screws with the lanyard secured to the top half ring by the metal ball.

FIG. 10 is a perspective view of the apparatus taking the form of a flexible strapping 128 with a large D-ring 130 on one end and a small D-ring 132 on the other. In this figure it can be seen that the flexible material meshes with the handle on the dumbbell. A secure fit is obtained when the handle is wrapped with the sheath portion of the apparatus and the small D-ring is passed through the large D-ring. The small D-ring provides the connection site for the spring-clip to the exercise instrument of choice.

Figure 11:
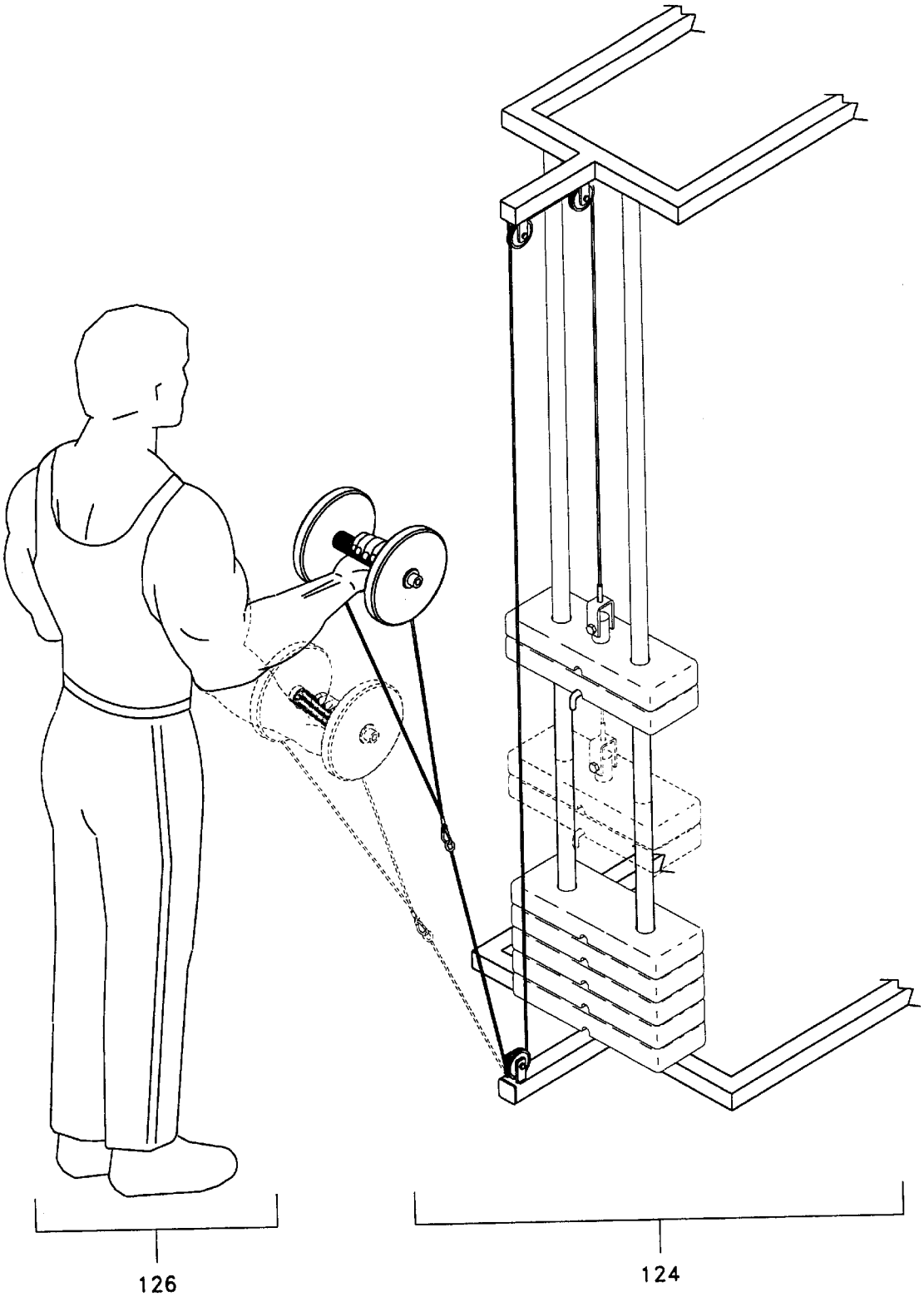
FIG. 11 shows a isometric animation of a human body holding the device shown in FIGS. 1A–1D with the method of utilizing the device in a exercise cycle having the bottom (dashed) and top (solid) position of a arm curl exercise.

FIG. 11—Method of connection and utilization

FIG. 11 is a perspective isometric view of an animated exercise cycle having a human animation 126 performing a biceps curl with the preferred embodiment attached to the exercise instrument of choice, in this case a cable pulley apparatus 124. Here the biceps curl is shown with a bottom and top position with a solid line depicting one position in tile movement and a dashed line indicating another.

Advantages

From the description above, a number of advantages of my multiple vector resistance device become evident:

(a) The device can be repositioned so that numerous exercises can be performed.

(b) The device can be easily attached and detached to different handles, dumbbells, barbells, or bars of various weights so that magnitudes of convergent force vectors can be changed independently and easily.

(c) The device can be used to challenge or stress the body by providing resistance to isometric, concentric and eccentric muscle contractions (d) The device offers the ability to change resistance load on a given muscle by opting to change either the magnitude or angles of the vectors of resistance together or independently, therefore increasing the users options for resistance training as compared to conventional equipment.

(e) Additional benefits can be found when utilizing the device in a unrestrained matter particularly without an external support structure which may dictated the path of motion and range of motion thereby decreasing the involvement of stabilizing musculature.

(f) The device is compact and easy to store after use resulting in minimal space consumption.

(g) The device being inexpensive to manufacture when compared to its numerous uses.

(h) A multitude of strength and conditioning protocols can be extracted from the device and its method of use.

(i) The device can be utilized, in a educational format, to promote and enhance knowledge pertaining to human movement against resistance including injury prevention and management.

(j) The device and method of resisting human movement does not require any electrical power source.

(k) The device can be used as a therapeutic modality and having a therapeutic purpose, which may provide numerous advantages to those injured or suffering ailments.

(l) The device affords simple application of other force vectors when exercising various muscle-groups so that the user can efficiently exercise without wasting time and energy between exercise cycles.

Operation—FIG. 11

The manner of using the convergent vector resistance equipment is not unlike the use of free-weights, elastic tubing, or selectable-cable-pulley equipment when used independently. The uniqueness being born from the connection of these devices and then ultimately manipulated by the user either for human performance, rehabilitation, health, or fitness purposes. Thus, the combination of multiple resistance vectors facilitates numerous options for the user, and when used in opposition of movement will promote various physiological changes, and supply a variety of possibilities for the user and intended use. The invention makes possible the connection for these exercise instruments onto the common unit of attachment also referred to as handle 20 shown in all figures with the "A" suffix. Once assembled as shown in FIGS. 1–10 detailing the individual pieces of each embodiment the device must then be connected to lanyard 104 by spring clip 94 or some quick link fastener (shown in previous figures with "D" suffix). Manipulation by user during the exercise cycle is shown by human animation 126 depicting an exercise known as the biceps curl detailing movement through a range of motion between the solid and dashed lines about the elbow axis.

The attachment of the device is made possible by assembling the preferred embodiment. Once the device is secure an intermediary connection between the device and the chosen exercise instrument, shown in this figure to be cable-pulley-system 124. This intermediary apparatus comprises the lanyard connected at both ends by a spring clip but could also consist of any attachment that would enable a secure connection between the device and exercise instrument.

From this figure it can be understood how the invention provides the opportunity to place resistance against human motion in numerous manners. For example, using the aforementioned figure imagine that the dumbbell being held in the hand of the user is b 10lbs., and the magnitude of the exercise instrument connected and pulling on the dumbbell is also 10 lbs. If the action lines of these two vectors is at 45° from each other the resulting action line of the combined vectors or convergent vectors would lye directly between or 22.5° from each. Furthermore, if the magnitude of the equipment is unequal, or the angles of the vectors are changed the resistance forces will change and the result will require a different response from the users muscular-skeletal system when moving the resistance.

Conclusion, Ramifications, and Scope

Accordingly, the reader will see that the device of the invention facilitating a common place of attachment for multiple vectors offorce will provide numerous possibilities to the user of such equipment. Many of such possibilities will become apparent when the device is used methodically for physical rehabilitation, sports medicine, injury prevention, and health/fitness exercise.

It can be repositioned so that numerous exercises can be performed.

It can be easily attached and detached to different handles, dumbbells, barbells, or bars of various weights so convergent force vectors can be changed independently and easily.

It can be used to challenge or stress the body by providing resistance to isometric, concentric and eccentric muscle contractions It offers the ability to change resistance load on a given muscle by the magnitudes and various positions of the resistance vectors thereby reducing the limitations of use imposed by conventional equipment.

It offers additional physiological benefits when the user utilizes equipment in an unsupported matter or without external support structure that directs the path and range of motion whereby decreasing involvement of stabilizing musculature.

It is compact and easy to store after use resulting in minimal space consumption.

It is relatively inexpensive to manufacture when compared to its counterpart when considering its numerous uses.

It provides a forum from which a multitude of strength and conditioning protocols can be found.

It can be utilized, in an educational format whereby experts in the field of exercise, health sports medicine, and rehabilitation can promote and enhance knowledge pertaining to human movement against resistance.

It does not require any electrical power source for its operation.

It can be used in a therapeutic modality and having a therapeutic purpose, which may provide numerous advantages to those injured or suffering ailments.

It offers simple application of other force vectors when exercising various muscle-groups so that exercise time can be efficient.

While my above description contains numerous specificities, these should not be construed as limitations on the scope of the invention, but rather as an exemplification of some of the presently preferred embodiments thereof. Many other variations are possible. For example the invention could be manufactured in common and exotic materials, untested embodiments, and come in various colors, shapes, forms, and designs including substitutions of individual parts and the order in which they are interchanged. Therefor, the scope of the invention should be determined not by the embodiment(s) illustrated, but by the appended claims and their legal equivalents.

I claim:

1. An exercise device for combining a vertical, gravitational exercise force vector with a second exercise force vector to provide a resultant, non-vertical exercise force vector, the device comprising:

an elongate member having a hand grip between first and second ends;

first and second end assemblies secured to respective first and second ends of said elongate member;

each end assembly comprising a weight member and an anchor;

each said anchor fastened to an end of at least one flexible member;

said at least one flexible member having a connection for selectively connecting to a means for providing the second exercise force vector;

each said weight member having an opening permitting a portion of said at least one flexible member to pass therethrough while said weight member is secured to said ends of said elongate member, whereby a user exercises against the resistance provided by the gravitational force of the weight members in combination with a resistance provided by the second exercise force vector.

2. The exercise device of claim 1, wherein each said anchor comprises an eyebolt secured to said respective first and second ends of said elongate member.

3. The exercise device of claim 1, wherein said opening in each said weight member comprises a hole through which said portion of said at least one flexible member passes.

4. The exercise device of claim 1, wherein said opening in each said weight member comprises a cutout through which said portion of said at least one flexible member passes.

5. The exercise device of claim 1, wherein said end of said at least one flexible member is connected to said anchor by a spring clip.

6. The exercise device of claim 1, wherein said anchor comprises a ball.

7. The exercise device of claim 1, wherein the second exercise force vector is provided by an exercise resistance selected from the group consisting of a selectorized weight resistance and an elastic cord.

8. The exercise device of claim 1, wherein said end assemblies are secured to said respective ends of said elongate member by a threaded connection.

9. The exercise device of claim 1, wherein said weight members are of a shape selected from the group consisting of round and hexagon. are hexagonal in shape.

10. An exercise device for combining a vertical, gravitational exerc an elongate member having a hand grip between first and second ends;

first and second end assemblies secured to respective first and second ends of said elongate member;

each end assembly comprising a weight member and an anchor;

each said anchor fastened to an end of at least one flexible member;

said at least one flexible member having a connector for selectively connecting to a means for providing the second exercise force vector;

each said weight member comprising a foramen and each said anchor comprising a ball held within said foramen of said weight member so that the ball and foramen create a swivel connection, whereby a user exercises against the resistance provided by the gravitational force of the weight members in combination with a resistance provided by the second exercise force vector.

11. The exercise device of claim 10, wherein said end of said at least one flexible member is fastened to said ball by a threaded connection.

12. The exercise device of claim 10, wherein each said weight member is secured to respective ends of said elongate member by a threaded connection.

13. The exercise device of claim 10, wherein said weight members are hexagonal in shape.

14. An exercise device for combining a vertical, gravitational exercise force vector with a second exercise force vector to provide a resultant, non-vertical exercise force vector, the device comprising:

an elongate member having a hand grip between first and second ends;

first and second end assemblies secured to respective first and second ends of said elongate member;

each end assembly comprising a weight member and an anchor;

each said anchor fastened to an end of at least one flexible member;

said at least one flexible member having a connection for selectively connecting to a means for providing the second exercise force vector;

each said anchor comprising a loop secured directly to said respective weight member, whereby a user may exercise against the resistance provided by the gravitational weight of the weight members in combination with a resistance provided by the second exercise force vector.

15. The exercise device of claim 14, wherein said end of said at least one flexible member is connected to said anchor by a spring clip.

16. The exercise device of claim 14, wherein the second exercise force vector is provided by an exercise resistance selected from the group consisting of a selectorized weight resistance and an elastic cord.

17. The exercise device of claim 14, wherein said end assemblies are secured to said respective ends of said elongate member by a threaded connection.

18. The exercise device of claim 14, wherein said weight members have a shape selected from the group consisting of round and hexagon.

19. The exercise device of claim 14, wherein said elongate member and said end assemblies are cast as a unitary structure.

* * * * *